US011807279B2

(12) United States Patent
Lambert

(10) Patent No.: US 11,807,279 B2
(45) Date of Patent: Nov. 7, 2023

(54) TRACK STRUCTURE WITH HOLLOW CENTER RAIL USABLE AS VENTILATION DUCT

(71) Applicant: RIINO Inc., Azilda (CA)

(72) Inventor: Aaron Kevin Lambert, Azilda (CA)

(73) Assignee: RIINO Inc., Azilda (CA)

( * ) Notice: Subject to any disclaimer, the term of this patent is extended or adjusted under 35 U.S.C. 154(b) by 0 days.

(21) Appl. No.: 18/197,350

(22) Filed: May 15, 2023

(65) Prior Publication Data

US 2023/0278596 A1 Sep. 7, 2023

Related U.S. Application Data

(63) Continuation of application No. PCT/CA2020/051805, filed on Dec. 29, 2020.

(51) Int. Cl.
*B61B 13/04* (2006.01)
*E21F 1/04* (2006.01)

(52) U.S. Cl.
CPC ..... *B61B 13/04* (2013.01); *E21F 1/04* (2013.01)

(58) Field of Classification Search
CPC ..... B61B 13/10; B61B 13/04; B61B 13/06; B61B 13/12; B61B 13/122; B61B 15/00; E01B 25/00; E01B 25/10
USPC ..... 104/118, 119, 120, 124, 125, 138.1; 105/141, 144, 145
See application file for complete search history.

(56) References Cited

U.S. PATENT DOCUMENTS 3,776,141 A * 12/1973 Gelhard ..... E01B 25/00 104/138.1
3,884,153 A 5/1975 Sugimoto
4,175,224 A 11/1979 Sims et al.
(Continued)

FOREIGN PATENT DOCUMENTS

GB 189500762 11/1895
GB 190506781 3/1904
(Continued)

OTHER PUBLICATIONS

"Fell Mountain Railway System," web page (Wikipedia article), URL: https://en.wikipedia.org/wiki/ Fell_mountain_railway_system, as retrieved on May 15, 2023.
(Continued)

*Primary Examiner* — Zachary L Kuhfuss

(57) ABSTRACT

In one aspect, a track structure usable by a wheeled vehicle for hauling a payload up an inclined enclosed passageway comprises a hollow rigid center rail member configured to act as both a center rail for the wheeled vehicle and as a ventilation duct. Opposite lateral faces of the hollow center rail member have respective wheel contact surfaces grippable by an opposed pair of inwardly-biased drive wheels of the wheeled vehicle. Rail support structure depends from the hollow center rail member. An elevated pair of rails is attached to the rail support structure, the rails being on opposite sides of and substantially parallel to the hollow center rail member. Each rail is supported by the rail support structure so as to provide an upper, lower, and lateral surface suitable for rolling engagement by a weight-bearing wheel, undermount wheel, and guide wheel, respectively, of the wheeled vehicle.

20 Claims, 22 Drawing Sheets

(56) References Cited

U.S. PATENT DOCUMENTS

| | | | | |
|---|---|---|---|---|
| 4,313,383 | A * | 2/1982 | Parazader | E01D 19/125 104/118 |
| 4,375,193 | A | 3/1983 | Sullivan | |
| 4,587,906 | A * | 5/1986 | Coester | B61C 11/06 104/156 |
| 4,635,559 | A * | 1/1987 | Nelson | B61B 13/06 104/119 |
| 6,182,576 | B1 * | 2/2001 | Svensson | B61B 13/04 104/243 |
| 6,450,103 | B2 * | 9/2002 | Svensson | B61B 13/04 104/243 |
| 6,564,516 | B1 * | 5/2003 | Svensson | B61B 13/04 104/118 |
| 6,564,722 | B1 | 5/2003 | Kurosawa et al. | |
| 10,583,846 | B2 | 3/2020 | Fisk et al. | |
| 2001/0037747 | A1 * | 11/2001 | Svensson | B61B 13/04 104/243 |
| 2002/0073876 | A1 * | 6/2002 | Einar | B61B 13/04 104/124 |
| 2010/0175961 | A1 * | 7/2010 | Rameau | B60M 1/307 191/22 DM |
| 2011/0056405 | A1 * | 3/2011 | Coester | E01B 25/10 104/124 |
| 2013/0186297 | A1 * | 7/2013 | Kissel | E01B 25/08 104/124 |
| 2014/0261055 | A1 * | 9/2014 | Oster | E01B 25/30 104/138.1 |
| 2018/0127003 | A1 | 5/2018 | Fisk et al. | |
| 2018/0208216 | A1 * | 7/2018 | Grip | B61B 13/10 |
| 2020/0001190 | A1 * | 1/2020 | Stelzl | A63G 7/00 |
| 2020/0284348 | A1 * | 9/2020 | Choi | G01M 3/2861 |
| 2023/0203758 | A1 * | 6/2023 | Xia | B61B 5/02 238/130 |

FOREIGN PATENT DOCUMENTS

| | | |
|---|---|---|
| WO | 1985005336 | 12/1985 |
| WO | 1991012982 | 9/1991 |
| WO | 1994023980 | 10/1994 |
| WO | 2009059362 | 5/2009 |
| WO | 2012086251 | 6/2012 |
| WO | 2014089452 A1 | 6/2014 |
| WO | 2018054011 | 3/2018 |
| ZA | 200110302 | 9/2002 |

OTHER PUBLICATIONS

"Rimukata Incline Railway," web page, URL: https://web.archive.org/web/20040606170507/http://www.rimutaka-incline-railway.org.nz/history/fell-centre-rail.html, last archived on May 4, 2013, as retrieved on May 15, 2023.

"Railveyor—Technology," web page, URL: https://www.railveyor.com/what-is-railveyor/technology/, as downloaded on May 15, 2023.

Inorail Mining Pumps & Monorails, Web page, http://www.inorail.com/products/monorail/monorail-transport-systems/emts-electric-monorail-transport-system.html, as retrieved on May 15, 2023.

"Miniclimber MC3," web page, URL: https://www.smtscharf.com/product/miniclimber_mc-3/?lang=en, as downloaded on May 15, 2023.

International Search Report and Written Opinion for International PCT patent application No. PCT/CA2020/051805 dated Sep. 17, 2021.

* cited by examiner

TRACK STRUCTURE WITH HOLLOW CENTER RAIL USABLE AS VENTILATION DUCT

CROSS-REFERENCE TO RELATED APPLICATIONS

This is a continuation of International PCT application No. PCT/CA2020/051805, entitled TRACK STRUCTURE WITH HOLLOW CENTER RAIL USABLE AS VENTILATION DUCT, filed on Dec. 29, 2020, which is incorporated herein by reference.

TECHNICAL FIELD

The present disclosure relates to a track structure, and more particularly to a track structure having a hollow center rail usable as a ventilation duct.

BACKGROUND

In the mining industry, excavated ore and development (waste) rock may be hauled from a subterranean mine to surface level through an inclined tunnel, which may be referred to as a "ramp" or "drift." Various types of vehicles may be used to haul the ore, or other payloads, up a ramp.

One type of vehicle that may be used for such hauling is a diesel haulage truck (or simply "diesel truck"). An example of a diesel truck used for mining is the Minetruck™ MT5020 sold by Epiroc Canada Inc., which has a 50-ton capacity. Diesel trucks are commonly used due to a low capital expenditure and versatility. However, diesel trucks are not highly ranked for efficiency and can result in high operating costs. This may be due to fuel consumption and cost required for operating labourers, high maintenance costs, increased ventilation requirement, and low energy consumption efficiency.

To accommodate a 50-ton diesel mining truck, an inclined tunnel may have a significant cross-sectional area. The cross-sectional area may be dictated primarily by the height and width of the diesel truck. However, another factor that may warrant a larger tunnel cross-sectional area is ventilation ducting.

A diesel mining truck engine may produce a significant amount of exhaust gases, at least some of which (e.g. carbon monoxide) are harmful to human health. Mining tunnels are commonly ventilated to minimize the risk from such exhaust to human occupants, and for other reasons, such as regulating temperature and dissipating dust. The amount of air that must be circulated through the tunnel and any associated mine for adequate safety may be significant. As such, it is not uncommon for ventilation pipes to have a large diameter, e.g. four feet or more. A mining tunnel may contain one or more such ventilation pipe(s) for conveying fresh air to a work area. As such, the cross-sectional area of the ramp may be required to accommodate not only the cross-sectional area of the truck but also the cross-sectional area of the ventilation pipe(s).

Some mining trucks, such as the Z50™ mining truck sold by Artisan Vehicles™, may be electrically powered. The absence of any emissions from such trucks may reduce, although not eliminate, ventilation requirements. Nevertheless, the cross-sectional are of a ramp that would be required to accommodate both a smaller ventilation pipe and a conventional truck may still be significant.

The grade of an inclined tunnel may be practically limited by the vehicles used to haul excavated ore to surface level.

For example, a mining truck with rubber wheels (e.g. 50-ton diesel truck) may have difficulty hauling payloads up grades steeper than 18%. The reason is that the truck's wheels may lose traction at grades steeper than 18%.

When prospective mining of a mineral deposit is being considered, a cost-benefit analysis may be performed to ensure that the estimated value of the minerals exceeds the estimated cost of mining the ore. If the cost of excavating an inclined tunnel for hauling ore is too great, there may be little incentive to mine the ore. Valuable mineral deposits may be left untapped if the cost of extracting them is perceived as too high.

SUMMARY

In one aspect of the present disclosure, there is provided a modular track segment of a track structure usable by a wheeled vehicle for hauling a payload up an inclined enclosed passageway, the modular track segment comprising: a hollow center rail member configured to act as both a center rail for the wheeled vehicle and as a ventilation duct, the hollow center rail member being rigid with open ends and having, on opposite lateral faces, respective wheel contact surfaces grippable by an opposed pair of inwardly-biased drive wheels of the wheeled vehicle; rail support structure depending from the hollow center rail member; an elevated pair of rails attached to the rail support structure, the rails being on opposite sides of and substantially parallel to the hollow center rail member, each rail being supported by the rail support structure so as to provide: an upper surface suitable for rolling engagement by a weight-bearing wheel of the wheeled vehicle; a lower surface suitable for rolling engagement by an undermount wheel of the wheeled vehicle; and a lateral surface suitable for rolling engagement by a guide wheel of the wheeled vehicle; and at least one connector configured to facilitate connection of the hollow center rail member with an adjacent hollow center rail member of an adjacent modular track segment so that respective open ends of the center rail members are aligned.

In another aspect of the present disclosure, there is provided a track structure usable by a wheeled vehicle for hauling a payload up an inclined enclosed passageway, the track structure comprising: a hollow center rail member configured to act as both a center rail for the wheeled vehicle and as a ventilation duct, the hollow center rail member being rigid and having, on opposite lateral faces, respective wheel contact surfaces grippable by an opposed pair of inwardly-biased drive wheels of the wheeled vehicle; rail support structure depending from the hollow center rail member; and an elevated pair of rails attached to the rail support structure, the rails being on opposite sides of and substantially parallel to the hollow center rail member, each rail being supported by the rail support structure so as to provide: an upper surface suitable for rolling engagement by a weight-bearing wheel of the wheeled vehicle; a lower surface suitable for rolling engagement by an undermount wheel of the wheeled vehicle; and a lateral surface suitable for rolling engagement by a guide wheel of the wheeled vehicle.

In a further aspect of the present disclosure, there is provided a method of ventilating a distal end of an enclosed passageway, the method comprising: extending a track structure previously installed in the enclosed passageway towards the distal end of the enclosed passageway, the track structure having an open-ended hollow center rail member configured to act as both a center rail for a wheeled vehicle and as a ventilation duct, by: aligning an open-ended hollow center rail member of a modular track segment with the open-ended hollow center rail member of the track structure; and attaching the modular track segment to the track structure to create a substantially airtight seal between the aligned hollow center rail member of the modular track segment and the hollow center rail member of the track structure; and conveying ventilation air through the hollow center rail member of the track structure into the hollow center rail member of the attached modular track segment for egress from a distal open end of the hollow center rail member of the attached modular track segment proximately to the distal end of the enclosed passageway.

BRIEF DESCRIPTION OF THE DRAWINGS

In the figures which illustrate example embodiments.

DETAILED DESCRIPTION

In this document, the term "exemplary" should be understood to mean "an example of" and not necessarily to mean that the example is preferable or optimal in some way.

Figure 1:
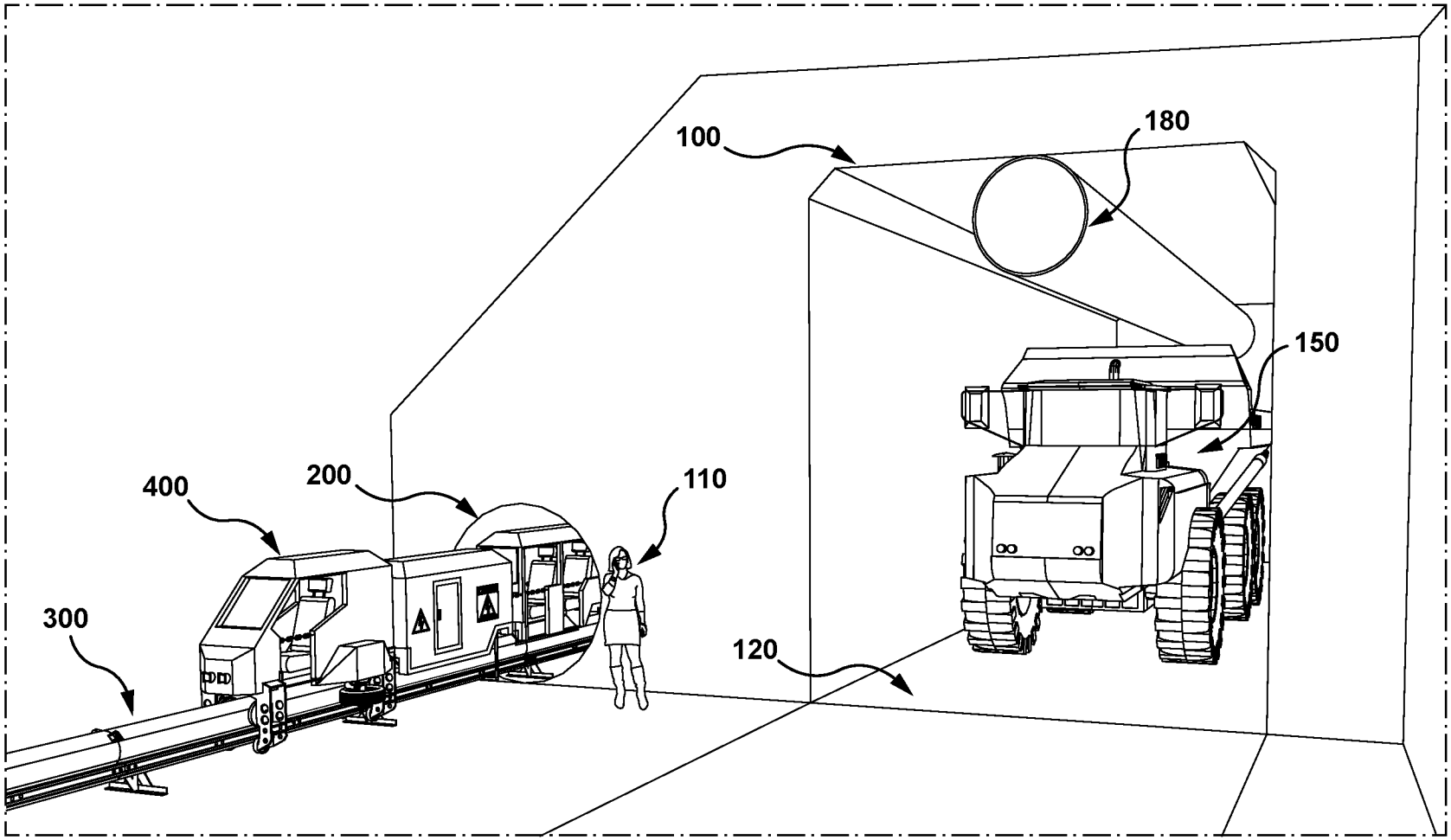
FIG. 1 is a perspective view of an entrance to a conventional inclined mining tunnel adjacent to an entrance to an inclined mining tunnel having an installed track structure exemplary of an embodiment of the present disclosure.

FIG. 1 is a perspective view depicting entrances to two mining tunnels 100 and 200, each being a form of enclosed passageway. The first mining tunnel 100 is conventional. The second mining tunnel 200 is new at least by virtue of the track structure 300 contained therein, which is exemplary of an embodiment of the present disclosure. It will be appreciated that the depiction of tunnels 100 and 200 side by side in FIG. 1 is to facilitate comparison and that, in practice, side-by-side construction of such distinct tunnels may be uncommon.

Although not visible in FIG. 1, each tunnel 100, 200 is inclined between its entrance and a subterranean work area. The tunnels 100, 200 are each intended for hauling development rock (excavated waste material) and excavated ore to the surface, each being a form of payload. However, as will be appreciated, the manner in which each of the tunnels 100, 200 is used for this purpose differs.

The conventional tunnel 100 is intended for use by conventional mining trucks 150 hauling ore from an underground mine to surface level. The mining trucks 150 may for example be Minetruck™ MT5020 50-ton trucks or similar trucks, having diesel engines, rubber tires, and a dump box.

As illustrated in FIG. 1, the conventional tunnel 100 has a substantially rectangular transverse cross section and a substantially flat floor 120 upon which the truck 150 is intended to be driven. The height and width of the example tunnel 100 is approximately 20 feet by 15 feet. As such, the cross-sectional area of tunnel 100 is approximately 300 square feet. It will be appreciated that these dimensions may vary somewhat between embodiments. In some embodiments, the conventional tunnel 100 may have a cross-sectional shape that is non-rectangular, e.g. with an arched ceiling.

The conventional tunnel 100 of FIG. 1 further accommodates a ventilation pipe (or duct) 180. The purpose of the ventilation pipe 180 is to ventilate a subterranean work area of the tunnel 100 with fresh air from surface level. The term "work area" as used herein refers to an area at which tunnel excavation or mining excavation work is being performed. The work area is typically located at the distal end of the tunnel 100 relative to the tunnel entrance.

Ventilation may be required at the work area to remove and/or to avoid buildup of at least one of: exhaust gases produced by the diesel engine of the mining truck 150; airborne particulates, e.g. dust contaminants produced from blasting activities during tunnel excavation; carbon dioxide from human exhalation; naturally occurring harmful underground gases (e.g. radon); heat; or a combination of these. In one example, it may be required to convey 100 cubic feet per minute (CFM) of fresh air into a work area for each horsepower of a diesel truck engine that is being used at or near the work area. This metric may vary from mine site to mine site, e.g. based on local regulatory and diesel emission efficiency requirements.

In the embodiment depicted in FIG. 1, the ventilation pipe 180 within tunnel 100 is a cylindrical pipe made from steel or a plastic resin or PVC and polyester fabric material for example. To meet anticipated ventilation requirements, the ventilation pipe 180 may have a diameter of approximately four feet. The exemplary ventilation pipe 180 of FIG. 1 is suspended from the ceiling of the tunnel 100, e.g. using brackets (not expressly depicted), at a height sufficient for mining trucks 150 to be able to safely pass underneath even when fully loaded with material.

The second tunnel 200 of FIG. 1 differs from the first tunnel 100 in at least four respects.

A first difference between tunnel 200 and conventional tunnel 100 is that the floor of tunnel 200 has a track structure 300 mounted thereto rather than simply being a flat surface upon which a vehicle is intended to be driven. The track structure 300 is elevated and is designed to carry a corresponding electrically powered wheeled vehicle 400 for hauling ore, development rock, personnel, equipment, or other payloads. As will be described, the manner in which the track structure 300 and vehicle 400 cooperate provides several advantages over conventional tunnels and trucks that may significantly reduce initial tunnel excavation costs. The advantages include a steeper maximum grade and the absence of any need for one or more separate ventilation pipes similar to ventilation pipe 180.

A second difference is that the cross-sectional shape of tunnel 200 is circular rather than substantially rectangular. The circular shape, although not strictly mandatory, may be chosen for various reasons. One possible rationale for the circular cross-sectional shape is that the tunnel may be required to extend deep underground, to reach as-yet untapped deposits. At greater depths, lateral inward forces on a tunnel may be so large that tunnel sidewalls, if cut vertically, would be prone to inward buckling ("hourglassing") or inward eruption in a phenomenon known as a "rock burst." A circular tunnel cross-section may limit the risk of such detrimental occurrences. As will become apparent, the installation of track structure 300 may also avoid the need to create a substantially flat tunnel floor, since the wheels of the wheeled vehicles to be driven through tunnel 200 will ride along the track structure 300, not directly on the floor of tunnel 200 as is the case for tunnel 100.

A third difference between the tunnels 100 and 200 is that the cross-sectional area of tunnel 200 is significantly smaller that than of conventional tunnel 100. This can be seen in FIG. 1, where tunnels 100 and 200 are depicted substantially to scale, with a person 110 depicted between them to provide a rough benchmark for size. In this example, tunnel 200 is approximately eight feet in diameter and thus has a circular cross-sectional area of approximately 50 square feet. That cross-sectional area is approximately six times smaller than the 300 square foot cross-sectional area of conventional tunnel 100. The significantly smaller cross-sectional area of tunnel 200 may considerably diminish the cost of excavating the tunnel in comparison to excavating conventional tunnel 100. This is by virtue of the smaller amount of material (e.g. rock) that must be excavated to create a given length of tunnel 200 as compared to the same length of wider and taller tunnel 100. The reduction in tunnel size may also significantly reduce the materials required for supporting the excavation (e.g. mechanical support types, rebar, screen, cable bolts, and/or schotcrete). As will be appreciated, the small cross-sectional area of tunnel 200 is attributable, at least in part, to the fact that the track structure 300 has a hollow center rail that is usable as a ventilation duct, thereby avoiding the need to accommodate one or more separate ventilation pipe(s).

A fourth difference between tunnel 200 and conventional tunnel 100, not discernible in FIG. 1, is that the incline of the former is steeper than that of the latter. In particular, tunnel 200 can have a grade less than or equal to 50% (i.e. 26.57 degrees or 1:2 gradient). In contrast, the maximum grade of tunnel 100 may be 18%. The steeper grade of tunnel 200 is made possible by cooperation between the track structure 300 and the wheeled vehicle 400, which provides robust traction that is not dependent on gravity and that permits payloads to be hauled even at a steeper grade. As will become apparent, the steeper grade of tunnel incline generally reduces the length of tunnel required to reach a target depth.

For clarity, the maximum 50% grade for tunnel 200 is determined in part by material angle of repose limits when carrying rock, sand, or gravel materials. The reason is that, at steeper grades than 50%, the angle of repose limits may be exceeded, and such materials may naturally shift and spill out of open-top dump boxes of wagon cars that may form part of the wheeled vehicle 400 (not expressly depicted).

Figure 2:
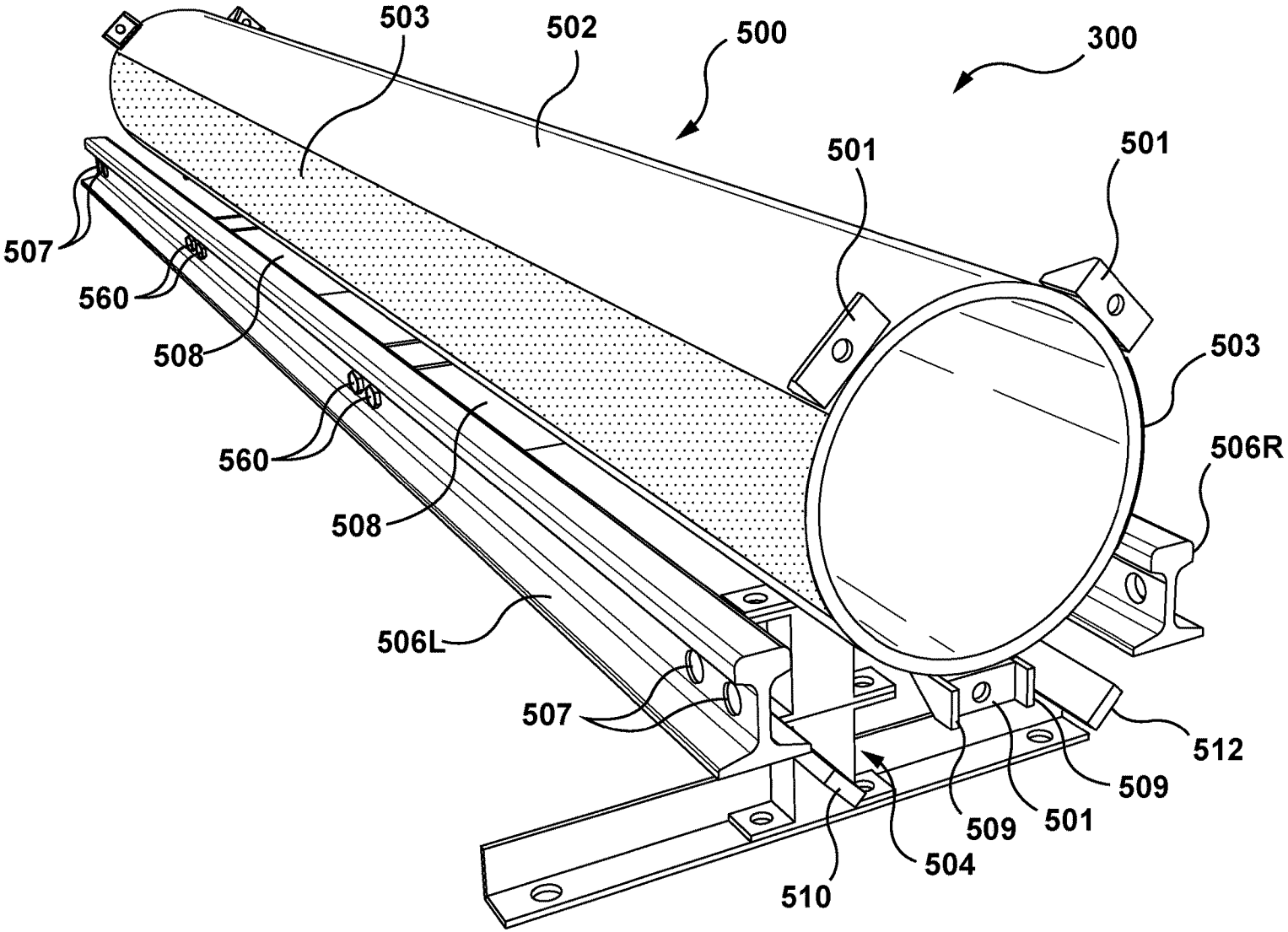
FIG. 2 is a front, top perspective view of a modular track segment that can be used to construct the track structure of FIG. 1 for a wheeled vehicle to haul a payload up the inclined tunnel.
Figure 3:
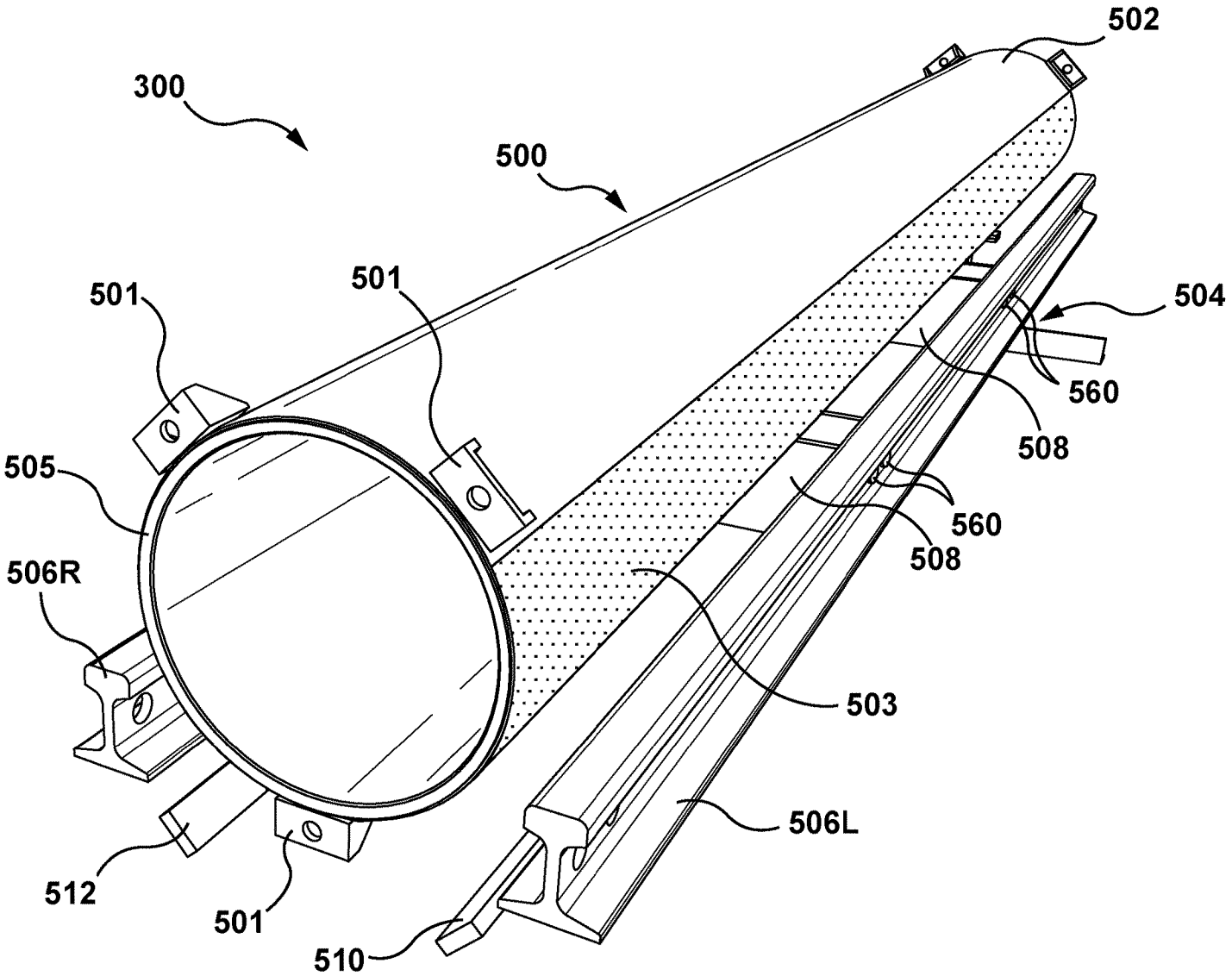
FIG. 3 is a rear, top perspective view of the modular track segment of FIG. 2.
Figure 4:
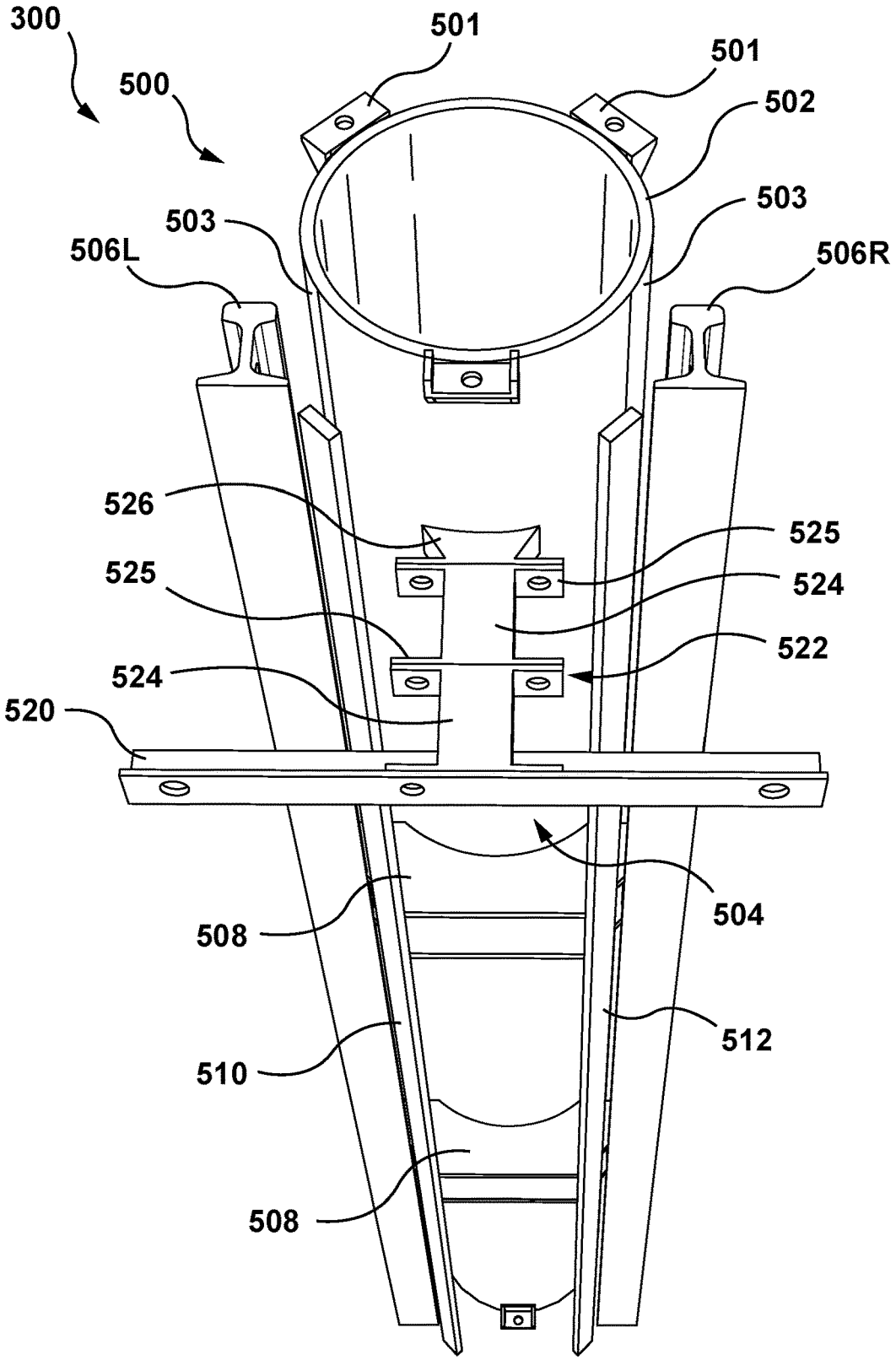
FIG. 4 is a front, bottom perspective view of the modular track segment of FIG. 2.
Figure 5:
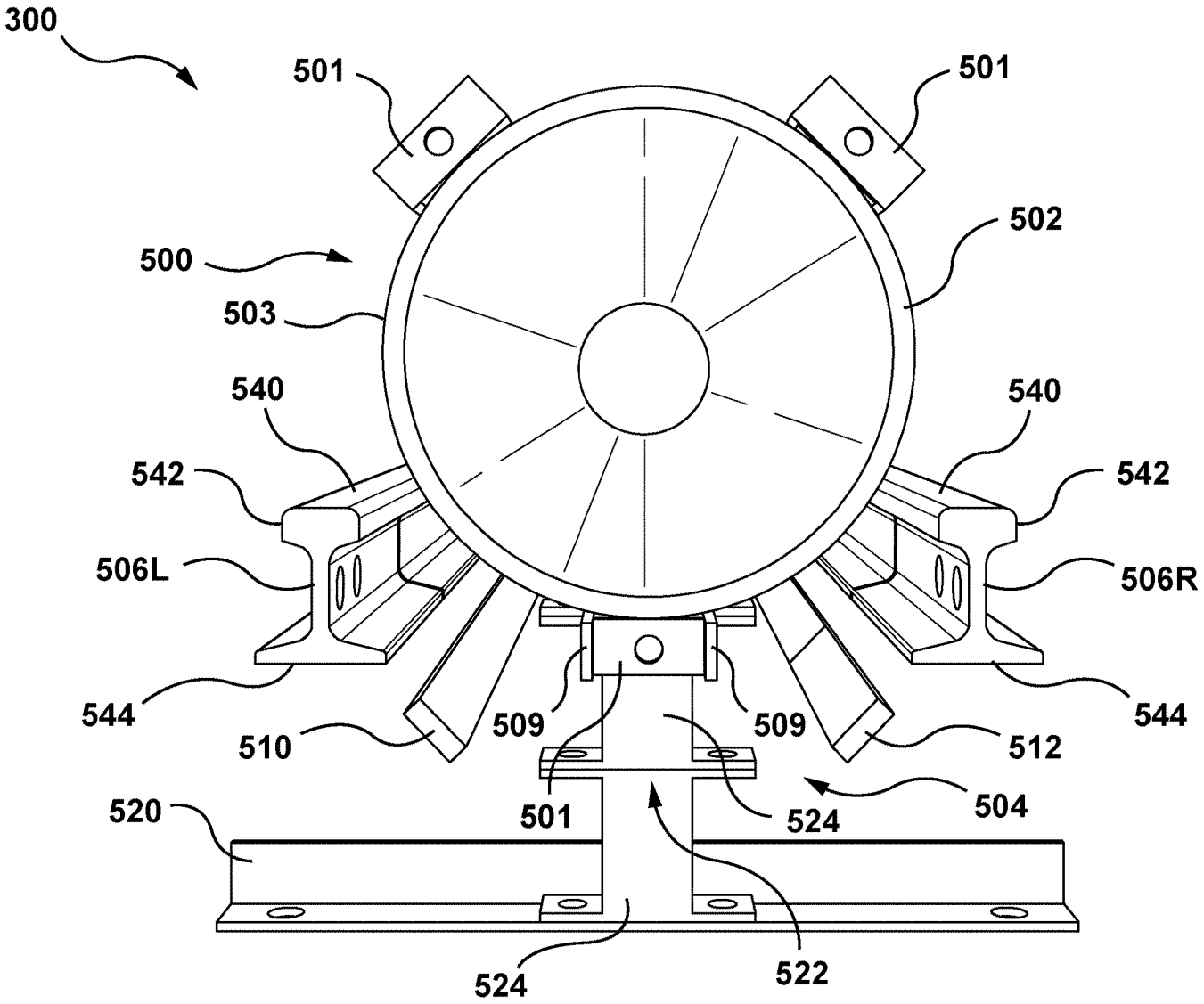
FIG. 5 is a front elevation view of the modular track segment of FIG. 2.

To facilitate/expedite installation, the track structure 300 may be assembled from multiple modular track segments. A single exemplary, straight modular track segment 500 of track structure 300 is depicted in FIGS. 2-5. In particular, FIGS. 2, 3, and 4 illustrate the modular track segment 500 in front top perspective view, rear top perspective view, and front bottom perspective view, respectively. FIG. 5 is a front elevation view of the track segment 500.

The depicted modular track segment 500 is a straight section of track. It will be appreciated that other types of modular track segments, e.g. laterally or vertically curved segments of various curvature radii, may also be used, possibly in combination with straight segments, to assemble a track structure 300 whose geometry conforms to that of tunnel 200 or of surface terrain.

The modular track segment 500 of FIGS. 2-5 is comprised of multiple components, including a center rail member 502, a support member 504, an elevated pair of rails 506L and 506R (generically or collectively rail(s) 506), rail support structure 508 comprising multiple brackets for attaching the rails 506 to the center rail member 502, and a pair of electrical conductors 510 and 512. These components may for example be formed into the unified modular track segment 500 depicted in FIGS. 2-5 in a factory setting. The track segment 500, possibly along with other track segments, may then be delivered to a mining excavation site for interconnection to form a track structure 300 on-site, as will be described.

The center rail member 502 is a rigid, hollow member with open ends. The center rail member 502 serves two primary purposes.

The first primary purpose of center rail member 502 is to act as a center rail for the drive unit of the wheeled vehicle 400. As will be described, a pair of opposed, inwardly biased, horizontally oriented drive wheels of the wheeled vehicle 400 is configured to grip or squeeze the center rail member 502 therebetween. The center rail member 502 accordingly has wheel contact surfaces 503 on opposite sides, i.e. on its outwardly facing lateral faces. In the illustrated example, each wheel contact surface 503 spans approximately 60 degrees of the cylindrical pipe circumference. When the drive wheels are made to rotate (in mirror image) on opposite sides of the gripped center rail member 502, they effectively pull themselves along the track structure 300 and thereby propel the wheeled vehicle 400 forward or backward.

The second primary purpose of center rail member 502 is to act as a ventilation duct, at least during the tunnel excavation process. It is for that reason that the center rail member 502 is hollow with open ends. A gasket or O-ring 505 (see FIG. 3) at the end of the hollow rail member 502 may promote an airtight seal between the center rail member 502 of the track segment 500 and a center rail member of an adjacent track segment. This may reduce the escape of ventilation air from the pipe to maintain efficiency and/or minimize ingress of contaminant materials or gases at track segment joints. The gasket 505 may for example be made from a resilient or elastic material, such as rubber.

The dual role of member 502 as both a center rail and as a ventilation pipe promotes efficient use of cross-sectional tunnel space. For example, the need for a separate, possibly large diameter ventilation pipe, such as ventilation pipe 180 of FIG. 1, in the tunnel, may be avoided. This may help to reduce tunnel excavation costs.

In the present embodiment, the center rail member 502 is a steel pipe with a 1-foot diameter. For some embodiments of steel pipe, the wall thickness may be one-half inch. The shape, composition, and dimensions of the hollow center rail member 502 may vary between embodiments. The rigidity of the center rail member 502 should be suitable for withstanding the lateral squeezing forces from the drive wheels without significant deformation. Factors such as the number of drive units per wheeled vehicle 400 may have a bearing on the required rigidity, e.g. because a greater number of drive units may reduce the degree of squeezing force required by any given drive unit for maintaining a desired coefficient of friction.

The wheel contact surfaces 503 may have a high-friction or abrasive surface for maximizing traction with the drive wheels. The extent to which this is required may be embodiment-specific, e.g. based on various factors, possibly including one or more of tunnel incline, expected payload weight, the frictional properties of the material from which the drive wheels are made, atmospheric conditions, and the presence of moisture (rain/dripping water), snow, and dust. If present, the high-friction or abrasive surface may be surface finishing or abrasion marking directly upon the surface of the center rail member 502.

Adjacent modular track segments 500 may be bolted together at connector flanges 501 (each being a form of connector) with respective open ends of the center rail members 502 being aligned to permit passage of ventilation air therethrough. In the present embodiment, three such connector flanges 501 extend radially from the periphery of each end of the cylindrical center rail member 502, equally spaced from one another about its circumference (120 degrees apart in this embodiment). At least one of the connector flanges 501 may have guides 509 (see e.g. FIG. 2) for facilitating alignment with a corresponding connector flange 501, which lacks such guides 509, of the adjacent center rail member 502 prior to interconnection of adjacent track segments 500.

The center rail member 502 acts as the primary supporting member or spine for the track structure 300. In this capacity, the center rail member 502 supports not only its own weight and that of the rails 506 of modular track segment 500, but also the weight of the wheeled vehicle 400 and its payload when it drives over the modular track segment 500.

Support member 504 elevates the center rail member 502, and thus the track structure 300 of which the center rail member 502 is a part, above a surface (floor) of a tunnel 200 in which the track structure 300 is installed. The support member 504 supports the weight of the track structure 300 as well as that of any passing wheeled vehicle 400 and its payload. One rationale for elevating the track structure 300 is to reduce the requirement for a substantially flat tunnel floor, as in conventional tunnel 100. A rationale for elevating the rails 506 specifically is to provide clearance for undermount wheels of the wheeled vehicle 400 to roll along an underside of the rails 506, as will be described below.

The modular track segment 500 depicted in FIGS. 2-5 has only one support member 504. The example support member 504 is disposed closer to one end of the track segment 500 than to the other. In this example, the modular track segment 500 is approximately 9 feet long, and the support member 504 is positioned approximately 1.5 feet from one end (i.e. at approximately 15% of track segment length). This design may be considered counter-intuitive, e.g. because a sole support member 504 that is so longitudinally offset may be considered ill-suited for elevating the entirety of track segment 500, at least independently of other track segments.

Nevertheless, the longitudinally offset support member 504 permits the track structure 300 as a whole to be conveniently elevated. The reason is that the track structure 300 is made up of multiple modular track segments 500 connected together end-to-end. In that arrangement, each support member 504 may support not only the end of the modular track segment 500 of which it is a part, but also a portion of the immediately adjacent interconnected modular track segment 500. Moreover, the sole support member 504 of a modular track segment 500 may facilitate vertical alignment of adjacent modular track segments 500 during installation of a track structure 300 within a tunnel, as will be described.

The use of only one support member 504 per modular track segment 500 may also facilitate installation. The reason is that each support member 504 of the present embodiment is intended to be anchored to the tunnel floor. Fewer support members 504 means that less time and effort may be required for such anchoring.

As perhaps best seen in FIGS. 4 and 5, the example support member 504 has a base portion 520, an adjustable-height leg portion 522 comprising two stacked leg segments 524, and a shoulder portion 526.

The base portion 520, which may be referred to as an anchor plate, is an elongate member oriented transversely to the center rail member 502. The extent of the base portion 520 in the transverse dimension of the example modular track segment 500 is greater than the spacing between rails 506L and 506R. In the present embodiment, the base portion 520 constitutes steel angle iron with holes to accommodate bolts (e.g. mechanical anchor bolts, such as Hilti™ anchor bolts) or other fasteners used to anchor the modular track segment 500 to the tunnel floor. The anchoring requirements may vary depending on the surface type and degree of tunnel incline. The design of the base portion 520 may vary in alternative embodiments. For example, the length, width, and/or shape of the base portion may be varied.

The leg portion 522 of support member 504 has an adjustable length (height). This may allow variations in tunnel floor topography to be accommodated while keeping the grade of adjacent modular track segments substantially consistent. In the present embodiment, the length of the leg portion 522 can be adjusted by changing the number of leg segments 524 that are used to comprising the leg portion 522. Each leg segment 524 of the instant embodiment has flanges 525 at its opposite ends, each flange with a hole therethrough. The flanges facilitate interconnection of leg segments 524 to one other or to other components, e.g. the base portion 520 or shoulder 526, using fasteners such as bolts (not expressly depicted). In alternative embodiments, the length of the support members may be adjustable in other ways besides stackable leg segments 524, e.g. telescopically.

The shoulder 526 of support member 504 (FIG. 4) may be permanently attached to the underside of the center rail member 502, e.g. by welding. The shoulder 526 transfers the weight of the center rail member 502 and its attached rails 506 to the leg portion 522.

The elevated pair of rails 506L, 506R (collectively rails 506) will bear a weight of the wheeled vehicle 400 and any payload that it may carry. The rails 506 may promote superior wheeled vehicle stability and may reduce wear and/or damage to connections (joints) between adjacent modular track segments 500, at least in comparison to a hypothetical alternative track structure lacking rails 506 in which the wheeled vehicle were to ride directly atop the center rail member.

The rails 506 used in the depicted embodiment are standard steel rails as commonly used for railway or subway systems. As such, each rail 506L, 506R has a broad head portion, narrow web portion, and a wide foot portion (not expressly labeled). The weight of the wheeled vehicle 400 is borne by non-drive wheels that roll along an upper surface 540 of a head portion of the rails 506, as will be described. The use of standard rails is not absolutely required.

The pair of rails 506 flanks the center rail member 502 and is substantially parallel thereto. In this disclosure, the term "flank" means to be on opposite sides of the center rail member 502, although not necessarily horizontally aligned with the axis of center rail member 502. In this embodiment, the rails 506L and 506R are disposed on the left and right sides, respectively, of center rail member 502 but closer to the ground. Put another way, the vertical positioning of the rails 506 in the present embodiment is at or near a lower extent of the center rail member 502 (see e.g. FIG. 5), e.g. with approximately three-quarters of the center rail member 502 above the upper surface 540 of the rail 506. This vertical positioning of the rails 506 relative to the center rail member 502 may help to reduce tunnel height requirements, at least in comparison to a hypothetical alternative track structure lacking rails 506 in which the wheeled vehicle rides directly atop the center rail member.

The size of the gap between each rail 506 and the center rail member 502 may be chosen with a view to reducing the likelihood that debris, such as falling rock, will become wedged between the rail 506 and the center rail member 502. Such an occurrence could potentially be disastrous, risking equipment damage or possibly vehicle derailment as a wheeled vehicle 400 passes by. The size of the gap may be chosen based on the grid size of a wire (e.g. rebar) mesh that may be applied to the tunnel ceiling with a view to limiting rockfalls. A common grid size is four inches square. In that case, the gap between each rail 506 and the center rail member 502 may be just over four inches, based on the logic that any rock small enough to pass through that size grid will likely be too small to become wedged in a gap of that size.

Each end of each rail 506 of the present embodiment has a pair of transverse through holes 507. The through holes 507 are for attachment of a splice bar (also known as a "fish plate") for splicing the rail 506 to a corresponding rail of an adjacent modular track segment 500. In alternative embodiments, the rails of adjacent modular track segments may be interconnected in other ways.

Figure 6:
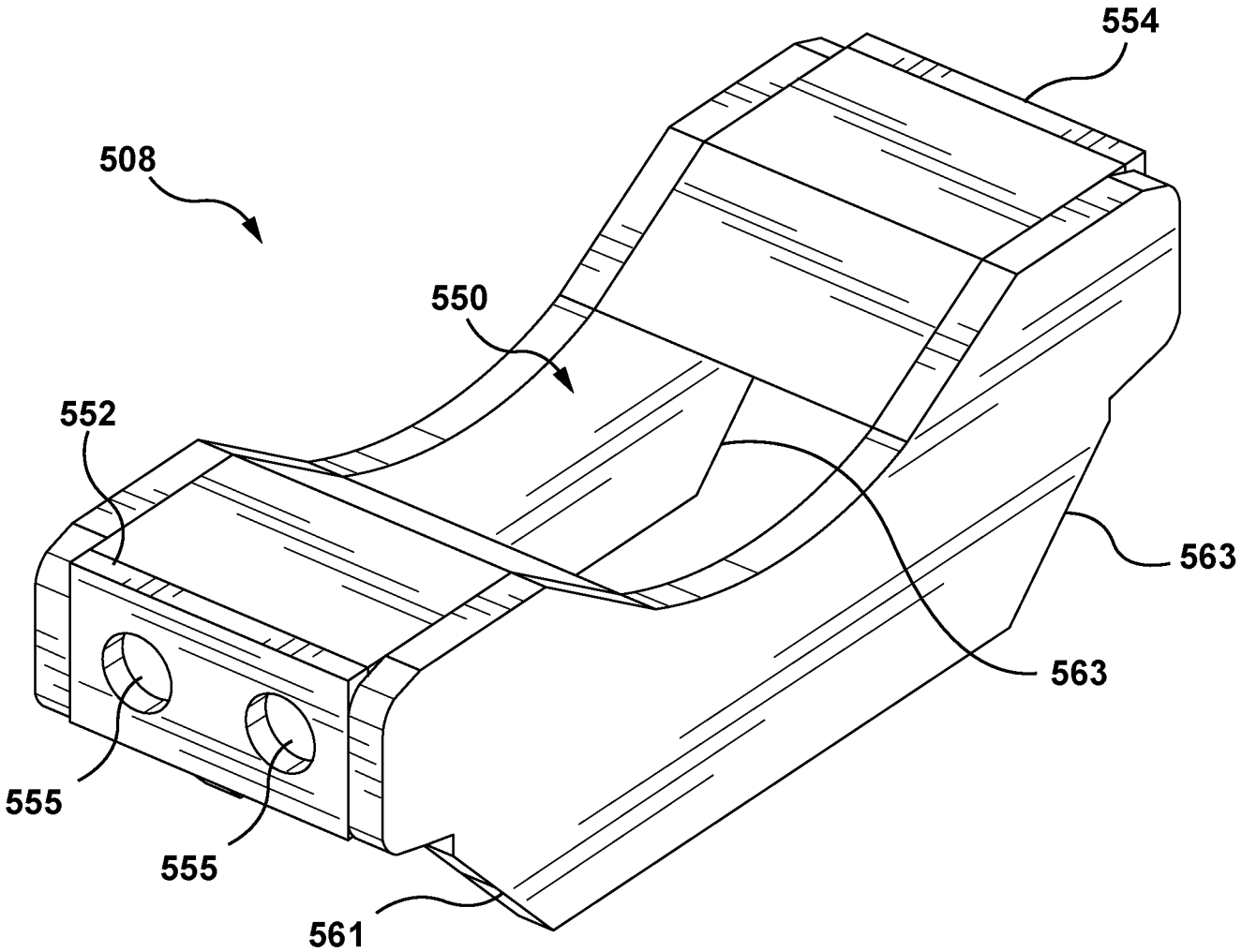
FIG. 6 is a top perspective view of a bracket component of the modular track segment of FIG. 2.
Figure 7:
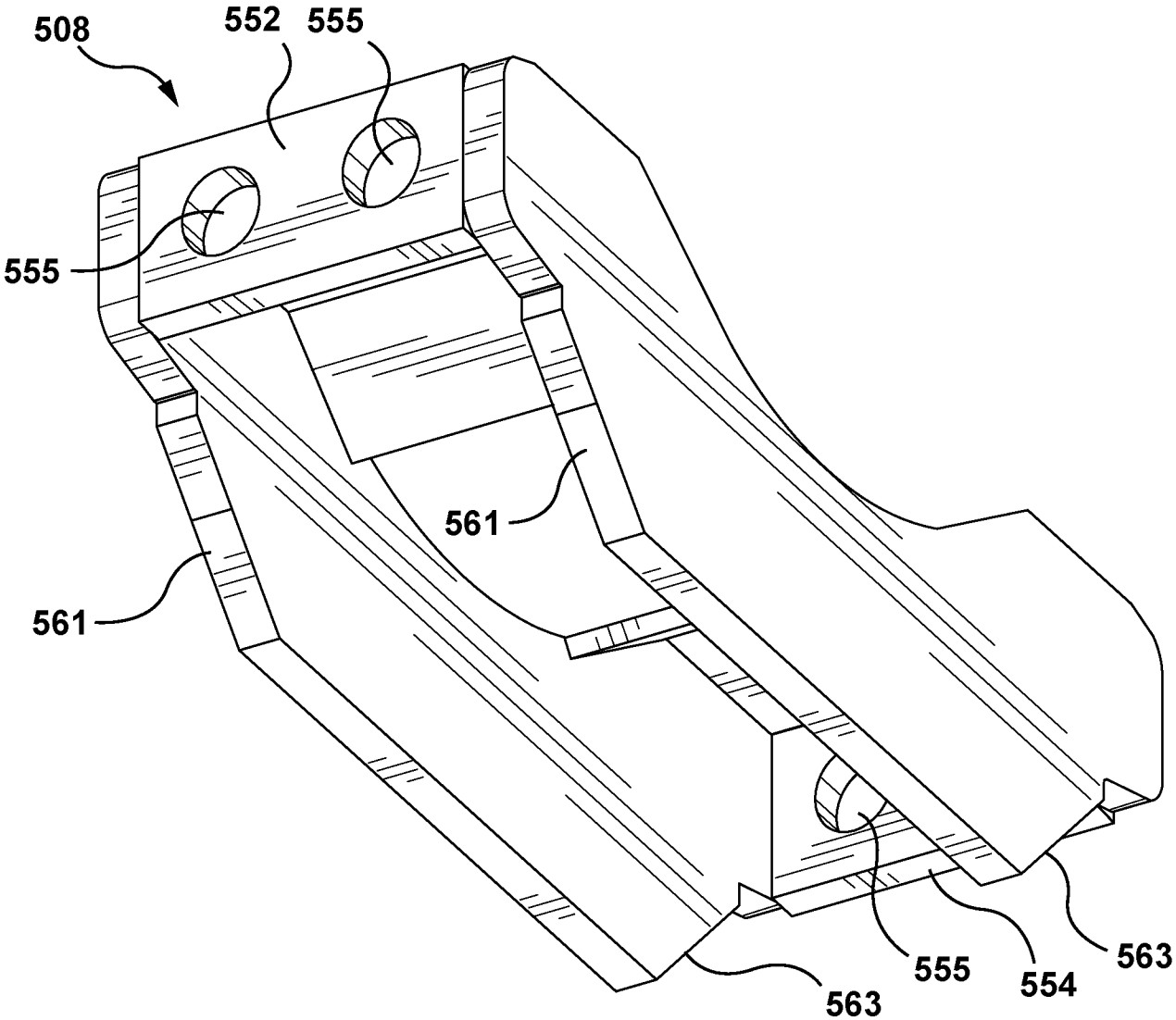
FIG. 7 is a bottom perspective view of a bracket component of the modular track segment of FIG. 2.

The rails 506L, 506R of the modular track segment 500 are attached to the center rail member 502 by way of rail support structure, which in the present embodiment comprises multiple brackets 508 (see e.g. FIG. 4). In the present embodiment, each modular track segment 500, which may be approximately 9 feet long, includes two brackets 508 spaced approximately 3 feet apart. FIGS. 6 and 7 depict a single example bracket 508 in isolation, in top perspective view and bottom perspective view, respectively.

As illustrated in FIGS. 6 and 7, bracket 508 is generally cradle-shaped, with a central indentation 550 in an upper middle portion thereof. The indentation has a part-circular profile with a radius generally matching the curvature of the outer surface of the center rail member 502. The indentation 550 is for receiving an underside of the center rail member 502, to which the bracket 508 may be attached, e.g. by welding.

A vertical plate 552, 554 at each respective end of bracket 508 has a pair of apertures 555 therethrough (see FIGS. 6 and 7). These apertures 555 are for receiving removable fasteners, such as bolts 560 (e.g. as shown in FIGS. 2 and 3), that will removably attach a standard rail 506 to the bracket 508. The standard rails 506 are removably attached because they may wear over time and may require replacement. In the present embodiment, each bolt 560 passes through one of the apertures 555 in vertical plate 552 or 554 and through a similar aperture in the standard rail 506.

The bracket 508 is sized so that, when standard rails 506L and 506R have been attached to plates 552 and 554 respectively, the desired track spacing is achieved. In the present embodiment, the separation distance between rails 506L and 506R is approximately 14 inches, but this distance may vary between embodiments. The ends of the example bracket 508 of the present embodiment extend slightly beyond the lateral extent (outer diameter measured horizontally) of the center rail member 502 when attached in place.

Referring to FIGS. 6 and 7, it can be seen that the bracket 508 also defines downwardly facing mounting surfaces 561 and 563 for mounting electrical conductors 510 and 512 (e.g. as shown in FIGS. 2 and 3) respectively to bracket 508. The conductors 510, 512 will be mounted thereto so that their exposed contact surfaces are downwardly facing to at least some extent. This orientation may reduce a risk of dust or debris buildup on the contact surfaces of the conductors which could interfere with electrical connectivity with electrical contacts on the drive unit of the wheeled vehicle. The conductors may be separated from the mounting surfaces 561, 563 by an electrical insulator (not illustrated). The conductors 510, 512 span the length of the modular track segment 500 so that electric current can be carried along the entire length of the track structure 300.

Figure 8:
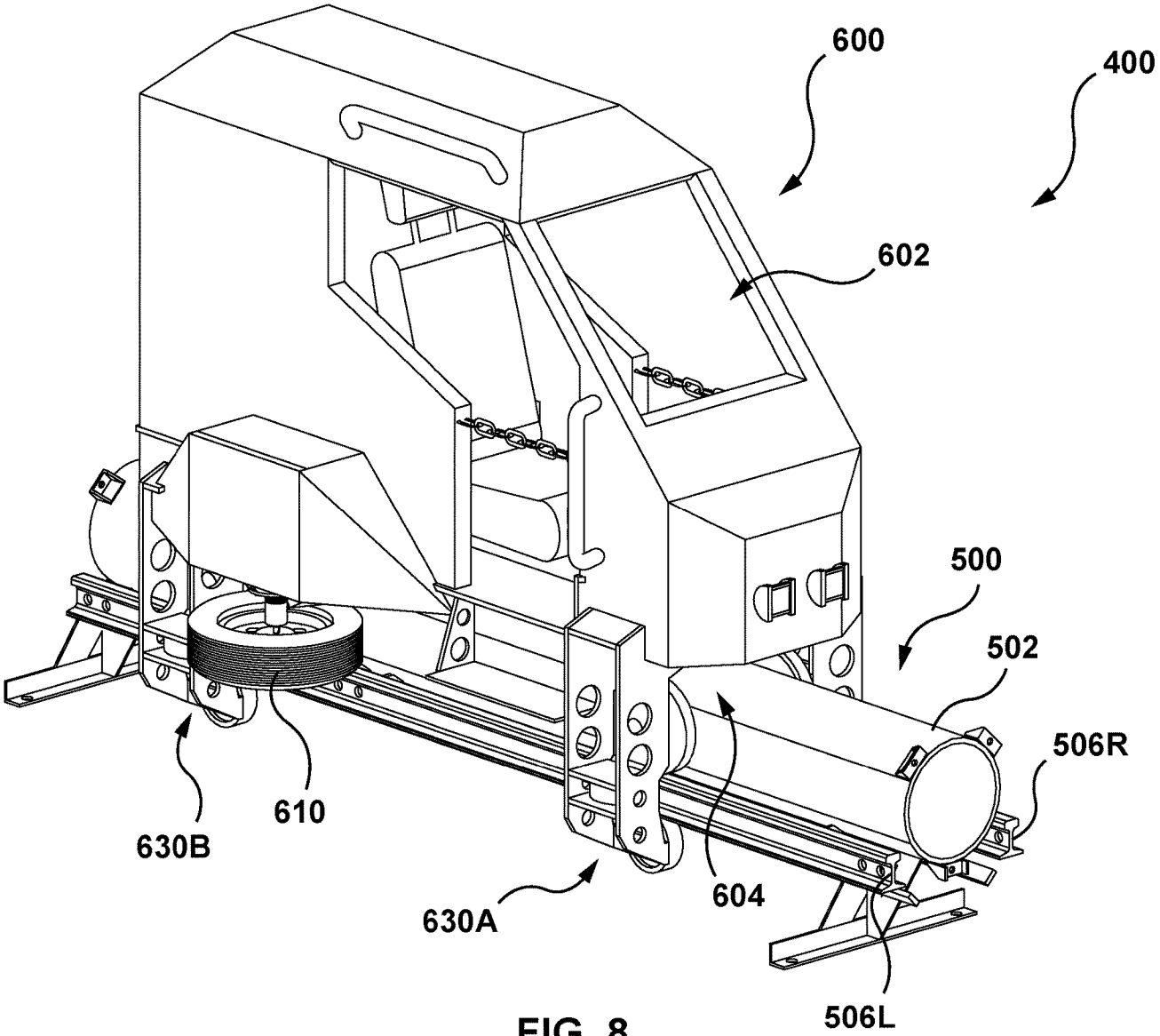
FIG. 8 is a perspective view of a drive unit of a wheeled vehicle atop the modular track segment of FIG. 2.

The wheeled vehicle 400 is designed specifically for driving on track structure 300. To illustrate the manner in which the wheeled vehicle 400 engages the track structure 300, an example drive unit (locomotive) 600 of the vehicle 400 is shown in FIG. 8, in perspective view, on an example modular track segment 500. The drive unit 600 may be connected to a series of other cars that collectively make up the wheeled vehicle 400, at least some having dump buckets for hauling a payload. If necessary, one or more additional drive units 600 may be added in series, e.g. for greater hauling power.

The drive unit 600 has a cab 602 for a human occupant who will act as the vehicle driver. It is not strictly required for the wheeled vehicle 400 to be driven by a human operator occupying a vehicle cab 602. In some embodiments, the wheeled vehicle 400 may be designed for automated or remote operation. In that case, the structure of the drive unit 600 may differ, e.g. omitting seat and windshield components in favor of cameras or other sensors.

Referring to FIG. 8, the cab 602 sits atop, and is attached to, a chassis 604. The chassis 604 is more readily visible in FIG. 9, which shows the drive unit 600 in perspective view with cab portion 602 removed, and in FIG. 10, which show the chassis 604 in top plan view without the track segment 500.

Figure 9:
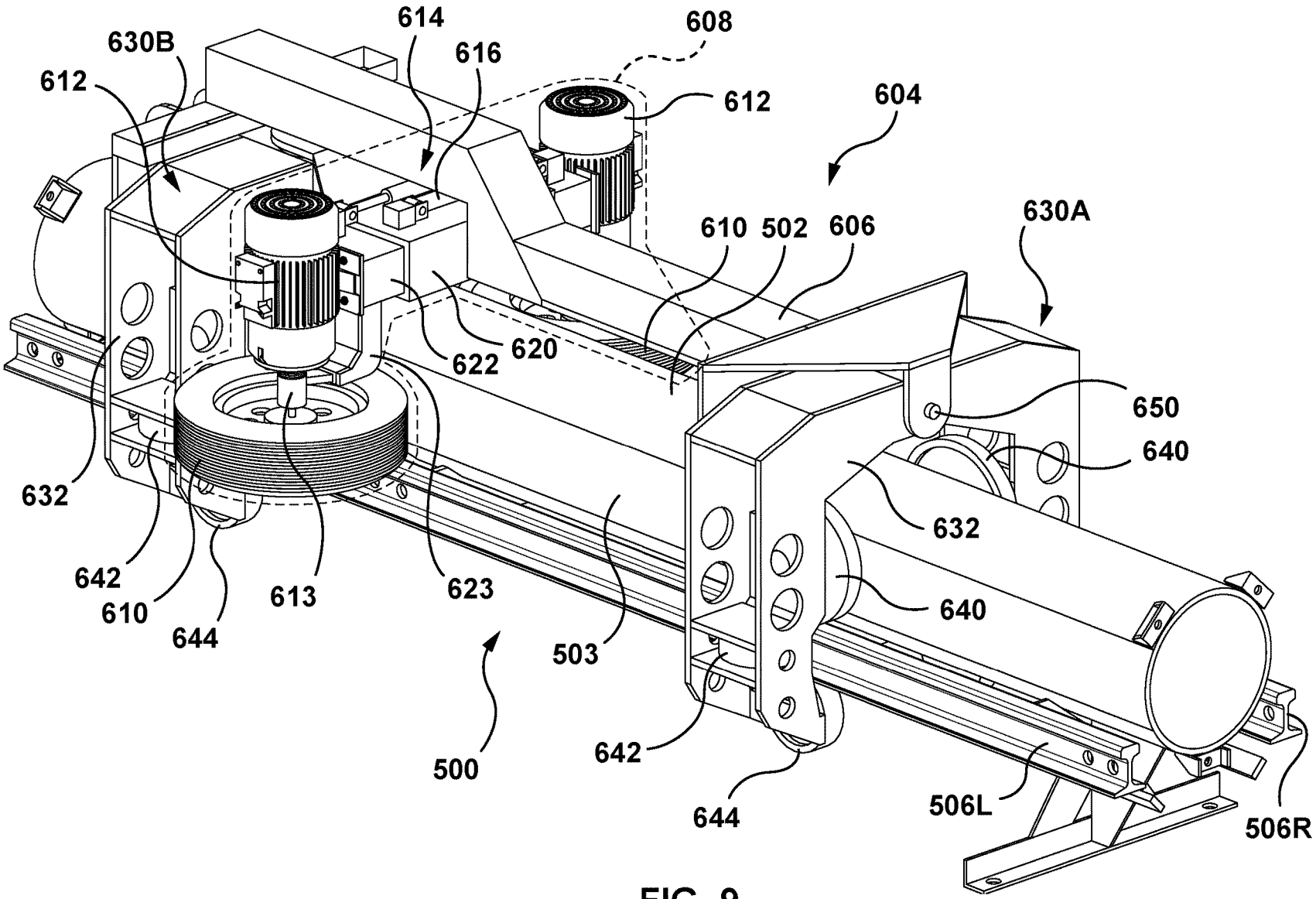
FIG. 9 is a perspective view of the drive unit of FIG. 8 with the cab portion removed to reveal the chassis of the drive unit.
Figure 10:
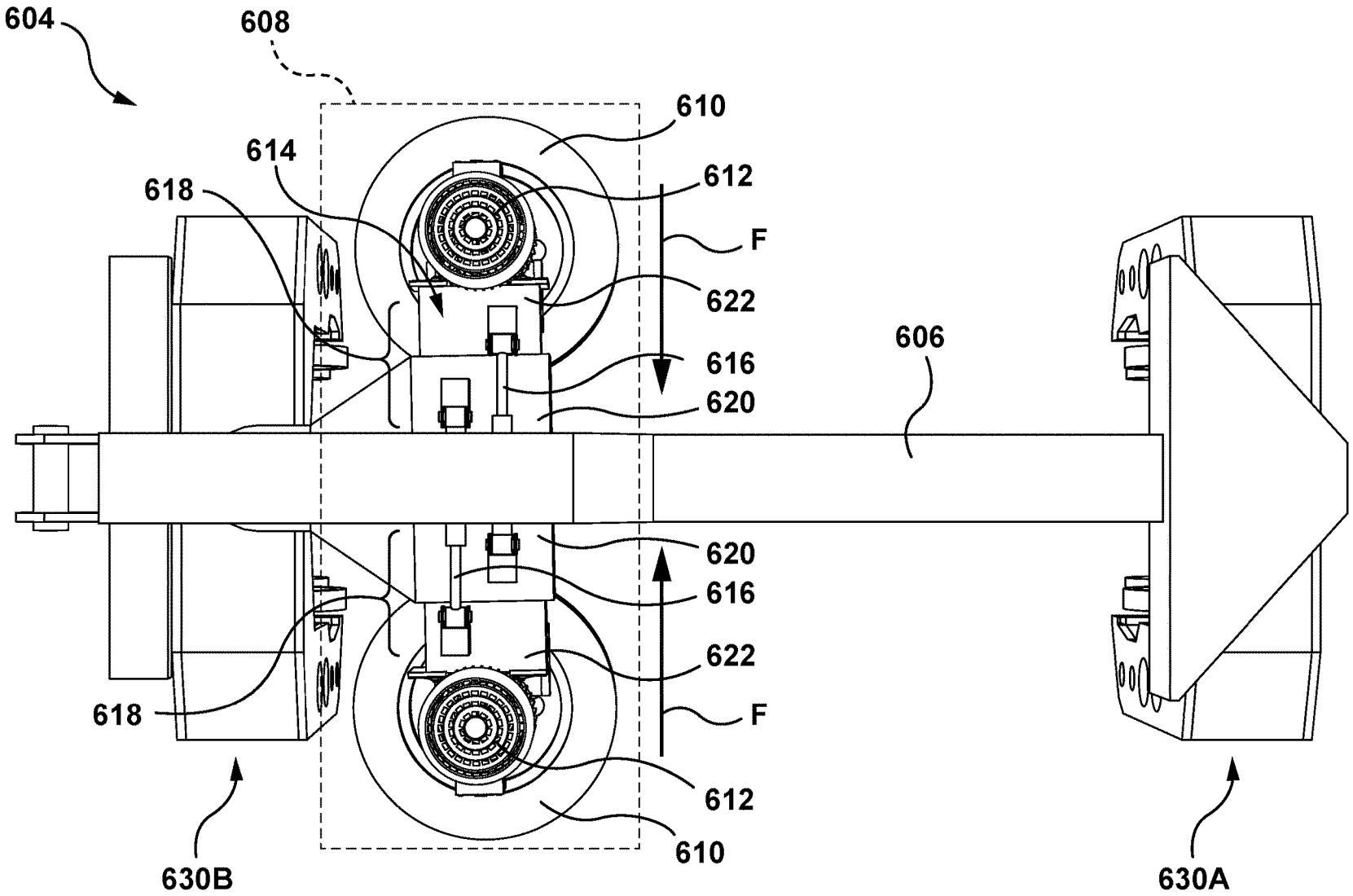
FIG. 10 is a top plan view of the chassis of FIG. 9.

As illustrated in FIGS. 9 and 10, the chassis 604 has a central frame member 606, a drive system 608, and two wheel assemblies 630A, 630B.

The central frame member 606 is a rigid elongate member that may be considered as the spine of the chassis 604. All other components of chassis 604 are attached, directly or indirectly, to the central frame member 606.

The drive system 608 is responsible for propelling the drive unit 600 of wheeled vehicle 400 along the track structure 300. To that end, the drive system 608 includes two drive wheels 610, two electric motors 612, and a traction system 614, among other components.

The two drive wheels 610 may for example be automotive or industrial tires, i.e. inflatable and made from rubber, or possibly a solid (not inflatable) tire. The use of a resilient material such as rubber for the drive wheels 610 may maximize traction against the wheel contact surfaces 503 of center rail member 502. The drive wheels 610 are disposed on either side of the central frame element 606 of chassis 604, i.e. on opposite sides of the center rail member 502 of the track segment 500, and are oriented substantially horizontally, i.e. with their axes of rotation being substantially vertical.

Each drive wheel 610 is driven by a respective one of the electric motors 612. A planetary gearbox 613 associated with each electric motor 612 provides torque conversion for turning the associated wheel 610 with suitable torque for propelling the vehicle 400 according to current operating conditions. The planetary gearbox 613 is used as a gearing reduction, similar to an automotive car starter. The torque may be monitored and varied during operation by the electric motor 612 using Variable Frequency Drives (VFDs). The drive wheels 610 rotate in opposite directions, i.e. in mirror image, because they grip the center rail member 502 from opposite sides.

Each electric motor 612 is powered by electricity from a transformer (not visible in FIG. 9) that is part of drive unit 600. The transformer is electrically coupled to a pair of electrical contacts located on the underside of the chassis 604 (also not visible in FIG. 9). The electrical contacts are biased against contact surfaces of the electrical conductors 510 and 512, respectively, of track structure 300, e.g. in a similar manner to electrical contacts used on subway train cars, to establish electrical contact therewith.

The traction system 614 of the drive unit 600 is responsible for causing the drive wheels 610 to grip or squeeze the center rail member 502 from opposite sides with a gripping force F, represented in FIG. 10 by inwardly pointing arrows. In the present embodiment, the gripping force F is generated by opposed hydraulic cylinders 616 (a form of biasing means), which bias the drive wheels 610 laterally towards one another. The traction system 614 is operable to manually and/or automatically adjust the degree of bias, i.e. the gripping force F. The forces may be monitored by in-line pressure sensors and adjusted by a hydraulic pump and accumulator. The forces applied may also be monitored by a Variable Frequency Drive for wheel traction and slip. The traction system 614 can thus maintain traction between drive wheels 610 and center rail member 502 regardless of dynamically changeable parameters, e.g. changes in the contact surface conditions, moisture, temperature, degree of incline, and center rail member 502 thickness. These conditions may be sensed through VFD automation controls, in a similar manner as an electric car.

To facilitate the dynamic adjustment of gripping force F, the lateral position of each drive wheel 610 is dynamically adjustable, as follows. Each drive wheel 610 is mounted at a distal end of a respective arm 618 whose length is adjustable (see e.g. FIG. 10). The two arms 618 extend in opposite directions laterally from the central frame member 606 of chassis 604. Each arm 618 has a fixed proximal portion 620 and a movable distal portion 622 terminated by a supporting member 623. The length of the arm 618 may be adjusted by telescopically sliding (translating) the distal movable arm portion 622 within (with respect to) the fixed proximal arm portion 620. The length of the arms 618 may be adjusted to accommodate the required squeeze force when maintaining traction of the tires and for the drive unit to transfer from one center rail member width to another. To prevent dust or grit from interfering with slidability, contact surfaces may be greased and/or suitable surface materials, such as Teflon™ for example, may be used.

At the distal end of each arm 618, a supporting member 623, having a J-shaped profile in the present embodiment, supports the electric motor 612 and the planetary gearbox 613. In the depicted embodiment, the bottom of the J-shaped supporting member 623 attaches to the planetary gearbox 613.

The adjustable bias of drive wheels 610 against the wheel contact surfaces 503 of center rail member 502 allows robust traction to be maintained between wheeled vehicle 400 and track structure 300, even under varying conditions. As a result, the wheeled vehicle 400 can be reliably driven at steeper grades than conventional mining trucks 150, for the following reason.

A conventional mining truck 150 relies solely upon gravitational force to establish traction between its wheels and the surface of the road. On a flat surface, gravity presses the truck tires directly downwardly (orthogonally) onto the road surface, and traction is maximized. The steeper the grade, the lesser the component of gravity that presses the tires directly (orthogonally) into the road surface. As such, tire traction becomes progressively worse at steeper angles, all other things being equal.

In contrast, the disclosed traction system 614 is not dependent on gravitational force. The inwardly biased drive wheels 610 can continue to apply force F upon the center rail member 502 to maintain traction even at steeper grades. This allows the tunnel 200 (FIG. 1) in which the track structure 300 is installed to be dug at a steeper grade than a conventional tunnel 100 without sacrificing vehicle traction. Consequently, tunnel excavation costs may be reduced in comparison to excavating a tunnel at a shallower grade, since the length of a tunnel dug at a steeper grade may be shorter than the length of a tunnel dug at a shallower grade.

As shown in FIGS. 9 and 10, the wheel assemblies 630A and 630B (collectively and generically wheel assembly/ies 630) of drive unit 600 are disposed at the front and rear end, respectively, of the chassis 604. A single example wheel assembly 630 is shown in perspective view in FIG. 11, in isolation from the remainder of chassis 604. The rails 506L, 506R are also illustrated in FIG. 11, with the remainder of the track structure 300 being omitted, so that that the interaction between the wheels of the assembly 630 and the rails 506 can more readily be seen.

Figure 11:
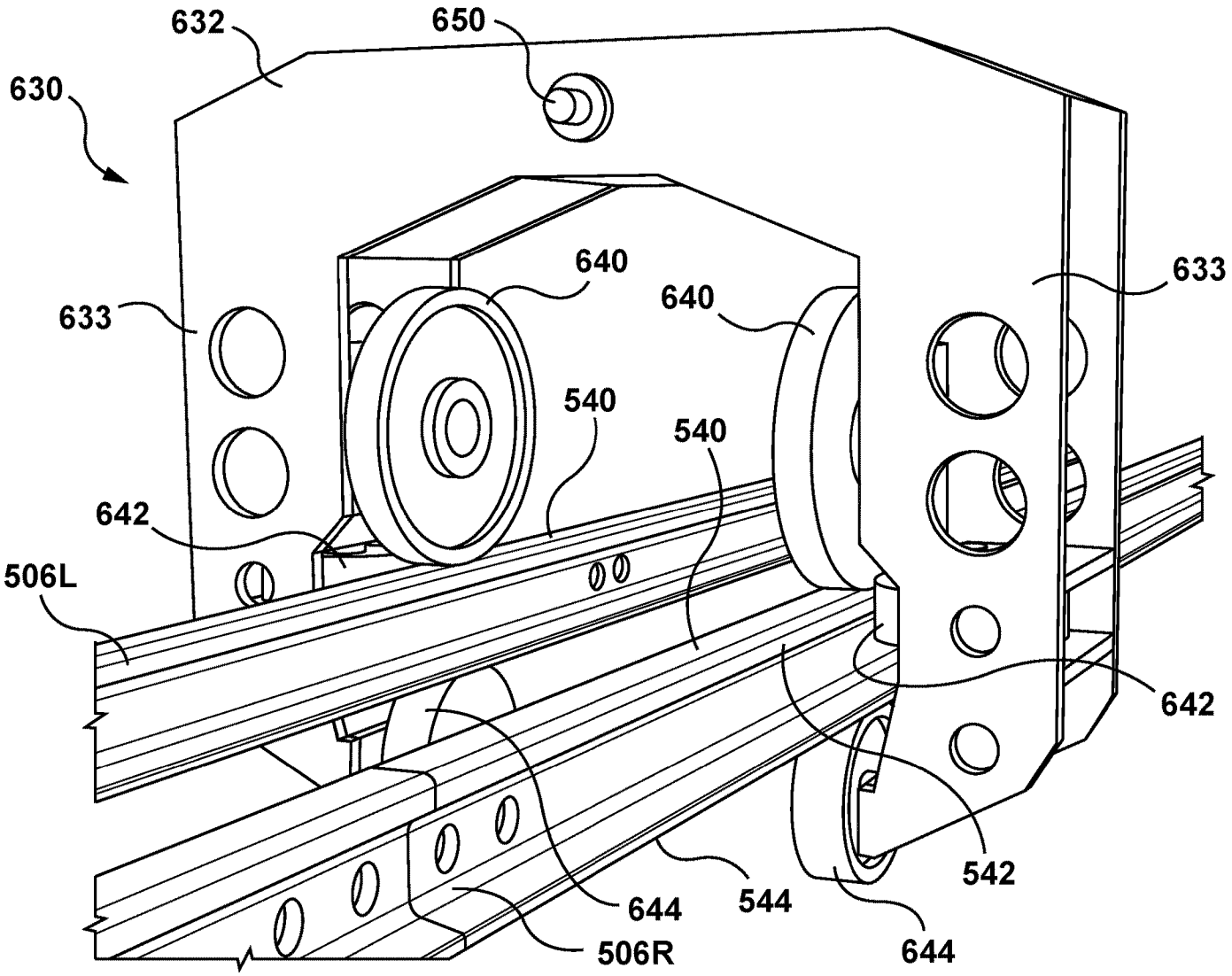
FIG. 11 is a perspective view of a single wheel assembly of the chassis of FIG. 9 in isolation from the remainder of the chassis.

As illustrated in FIG. 11, the wheel assembly 630 comprises a generally inverted U-shaped frame 632 having two downwardly pointing prongs 633. Each prong 633 has three wheels attached thereto: a top wheel 640; a side wheel 642; and an undermount wheel 644.

The top wheel 640 has a horizontal rotation axis and is positioned to roll along an upper surface 540 of the rail 506, which in this embodiment is the upper surface 540 of the head portion of the standard rail 506. The upper surface 540 is suitable for rolling engagement by the top wheel 640, e.g. is even and lacks any wheel obstructions. The wheel 640 bears/transfers the weight of the wheeled vehicle 400 from frame 632 to the rail 506 and thus may be referred to as a weight-bearing wheel. The diameter of the top wheel 640 may be larger than that of the side and bottom wheels 642 and 644. Larger diameter wheels may reduce rolling resistance with increased efficiency due to lesser frictional losses compared to smaller wheels.

The side wheel 642 has a vertical rotation axis and is positioned to roll along a lateral surface of the rail 506. In this embodiment, the side wheel rolls along the outer lateral surface 542 of the head portion of the standard rail 506. The lateral surface 542 is suitable for rolling engagement by the side wheel 642, e.g. is even and lacks wheel obstructions. For clarity, the side wheel 642 does not roll along the narrower web portion of the standard rail 506, in view of obstructions that may protrude outwardly from that surface (e.g. bolts 560 splice bars, or the like). The side wheels 642 are collectively intended to limit side-to-side shifting of the drive unit 600, and of the wheeled vehicle 400 of which the drive unit 600 is a part, with respect to the rails 506, which may reduce a risk of vehicle derailment. Each side wheel 642 may be referred to as a guide wheel. The diameter of the side wheel 642 is smaller than that of the top wheel 640, at least in part to minimize a width of the wheeled vehicle 400.

The undermount wheel 644 has a horizontal rotation axis and is intended to roll along a lower surface (underside) 544 of the rail 506. In this embodiment, the undermount wheel 644 rolls along an underside of the foot portion of standard rail 506. This wheel is intended to prevent the drive unit 600 from lifting off the standard rails 506, to reduce a risk of derailment. The lower surface 544 is suitable for rolling engagement by the undermount wheel 644, e.g. is even and has sufficient ground clearance for the wheel 644. Minimizing a diameter of the undermount wheels 644 may minimize the required ground clearance.

The top wheel 640, side wheel 642, and undermount wheel 644 on each prong 633 of the U-shaped frame 632 are arranged in mirror image to those of the other prong 633. Collectively, these six wheels may be considered to surround the pair of rails 506L, 506R from the top, bottom, and outside, as best seen in FIG. 11. This arrangement may minimize a risk of derailment of the drive unit 600 from track structure 300.

Each of wheels 640, 642, and 644 is non-flanged. It will be appreciated that pairs of flanged wheels interconnected by rigid axles are commonly used on conventional trains for lateral stability on train tracks. However, such an approach would be ill-suited for the track structure 300 because the center rail member 502 would block or obstruct such rigid axles. Non-flanged wheels may beneficially provide a lower-friction interaction between wheels and rails (as compared to flanged wheels), which may provided improved efficiency and reduced rail wear compared to flanged wheels. The wheels 640, 621, and 644 may for example be made from steel, nylon, or polyurethane materials, or a combination of these.

The U-shaped frame 632 is sized and shaped so that, when the wheel assembly 630 rolls along the rails 506, the frame 632 clears (does not come into contact with) the center rail member 502.

A pivot rod 650 through the middle of the U-shaped frame 632 serves as a point of attachment of the wheel assembly 630 to the central frame member 606. This pivot rod 650 allows side-to-side (one-dimensional) pivoting of the wheel assembly 630 with respect to the central frame member 606. The pivot may be used for the front and rear wheel assemblies of a lead car of the wheeled vehicle 400, which may be drive unit 600. This may facilitate navigation through lateral and horizontal turns in the track structure 300.

Figure 12:
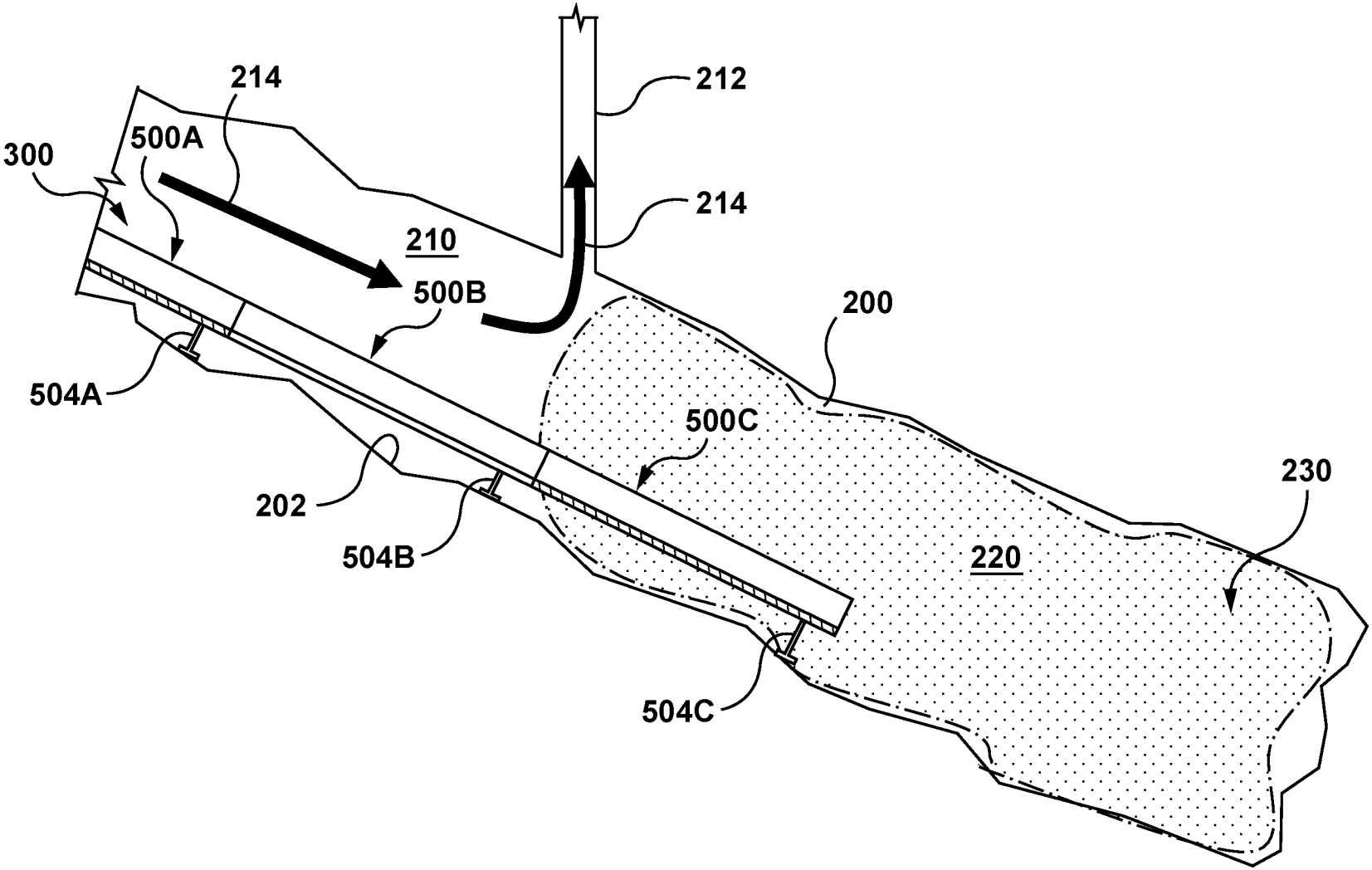
FIG. 12 schematically depicts ventilation problems that may arise during excavation of the tunnel of FIG. 1.
Figure 13:
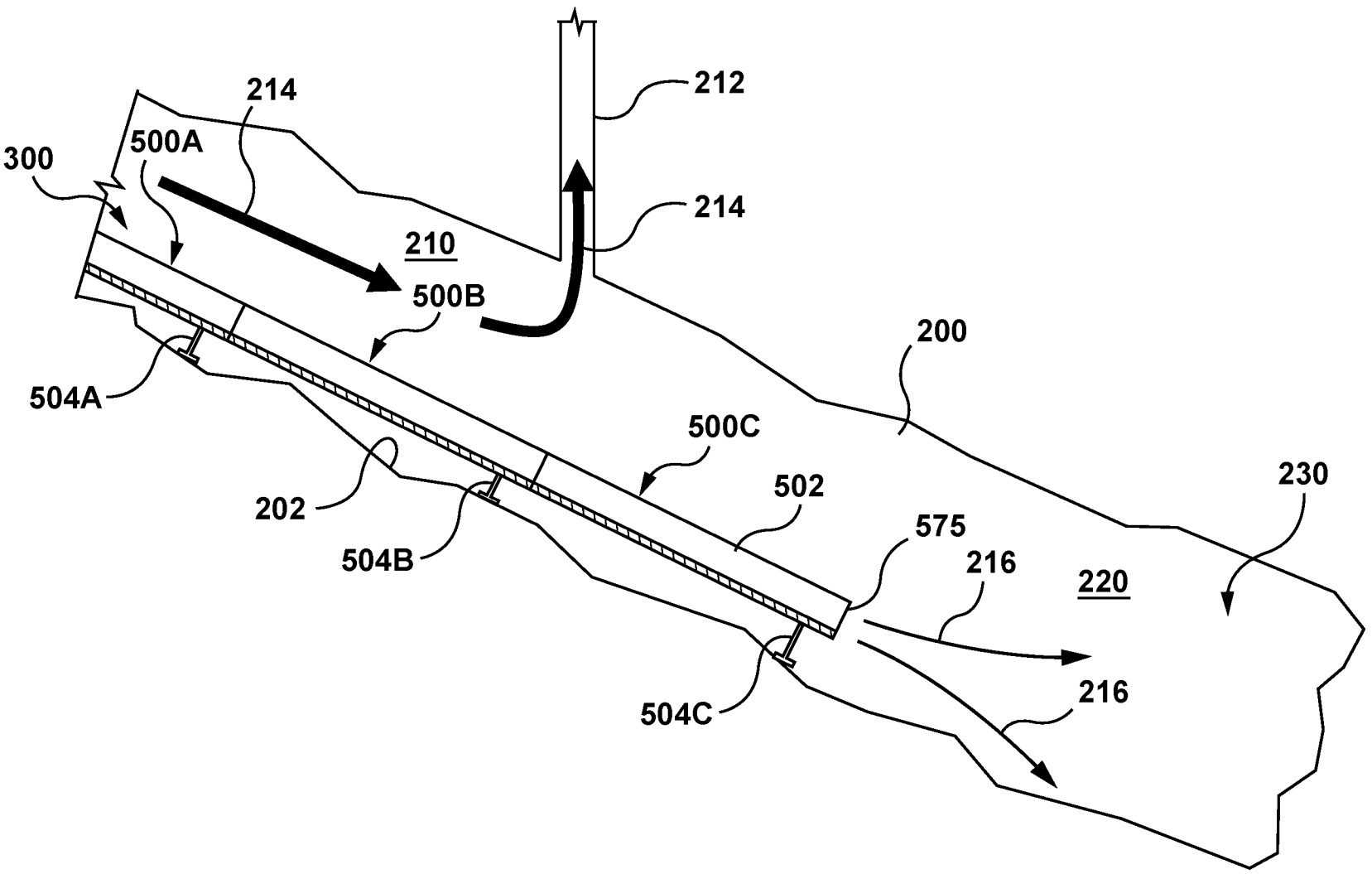
FIG. 13 schematically depicts supplementary ventilation that may be performed in the tunnel of FIG. 12 using the track structure of FIG. 1.

FIGS. 12 and 13 are schematic depictions of tunnel 200, during its excavation, as track structure 300 is being installed. The installed portion of track structure 300 that is visible in FIGS. 12 and 13 is made up of multiple modular track segments 500A, 500B, and 500C that have been interconnected and anchored to the tunnel floor 202. As will be described, the track structure 300 may be assembled piecemeal through attachment of additional modular track segments 500 just behind a work area 230 in which the tunnel is being excavated. Where installation is to be performed in a location lacking a solid rock surface, concrete pads or other methods of securing the track, e.g. screw posts, may be used.

As illustrated in FIGS. 12 and 13, the topography of the tunnel floor 202 may be uneven. This my for example be due the excavation techniques used to form the tunnel 200. These techniques may for example involve drilling holes in a rock face at a terminus (distal end) of tunnel 200, packing the holes with explosives, discharging the explosives to break the rock apart into rubble, and removing the rubble. To compensate for any unevenness in the floor 202 (see FIG. 12), the length of each support member 504A, 504B, and 504C of modular track segments 500A, 500B, and 500C respectively may be suitably adjusted. In the result, the longitudinal axes of track segments 500A, 500B, and 500C may be substantially aligned so that the track structure 300 is substantially straight.

The depicted portion of tunnel 200 may be considered to have two sections: a well-ventilated section 210 and a poorly ventilated section 220.

The well-ventilated section 210 may be ventilated by industrial fans at surface level (not depicted) that blow fresh air into the entrance of tunnel 200. A vertical borehole (referred to as a "raise") 212 that has been drilled into tunnel 200 from surface level provides an exit path for exhaust. As such, fresh air may continuously circulate in a loop 214 that includes the well-ventilated section 210. The raise 212 may be one of multiple raises drilled at regular or predetermined points along the length of the tunnel 200.

In contrast, the poorly ventilated section 220 of tunnel 200 may be considered as a ventilation "dead zone" by virtue of being outside the circulation loop 214 of fresh air that flows in from surface level and out through raise 212 (see FIG. 12). As such, harmful gases, dust, and/or heat may accumulate in this "dead end" section 220 at the distal end of tunnel 200. These may pose a significant risk to any mining personnel occupying tunnel section 220, who may be required to perform further excavation work at the work area 230, e.g. to further extend the tunnel 200.

To reduce such risk to any mining personnel occupying the poorly ventilated section 220, the hollow center rail member 502 of the track structure 300 can be used to provide supplementary ventilation in addition to whatever ventilation may be provided to tunnel section 210 via loop 214. This supplementary ventilation is depicted in FIG. 13. In particular, supplementary fresh air (ventilation) 216 may be blown into an open end of the center rail member 502 of track structure 300 at surface level, or possibly at an interval along the track structure 300 having fresh air provided by mine ventilation, e.g. using the mechanism depicted in FIGS. 21 and 22, described below. The fresh air may be conveyed along the length of the track structure 300 until it exits the open end 575 of the center rail member 502 of the last modular track segment 500C.

Figure 14:
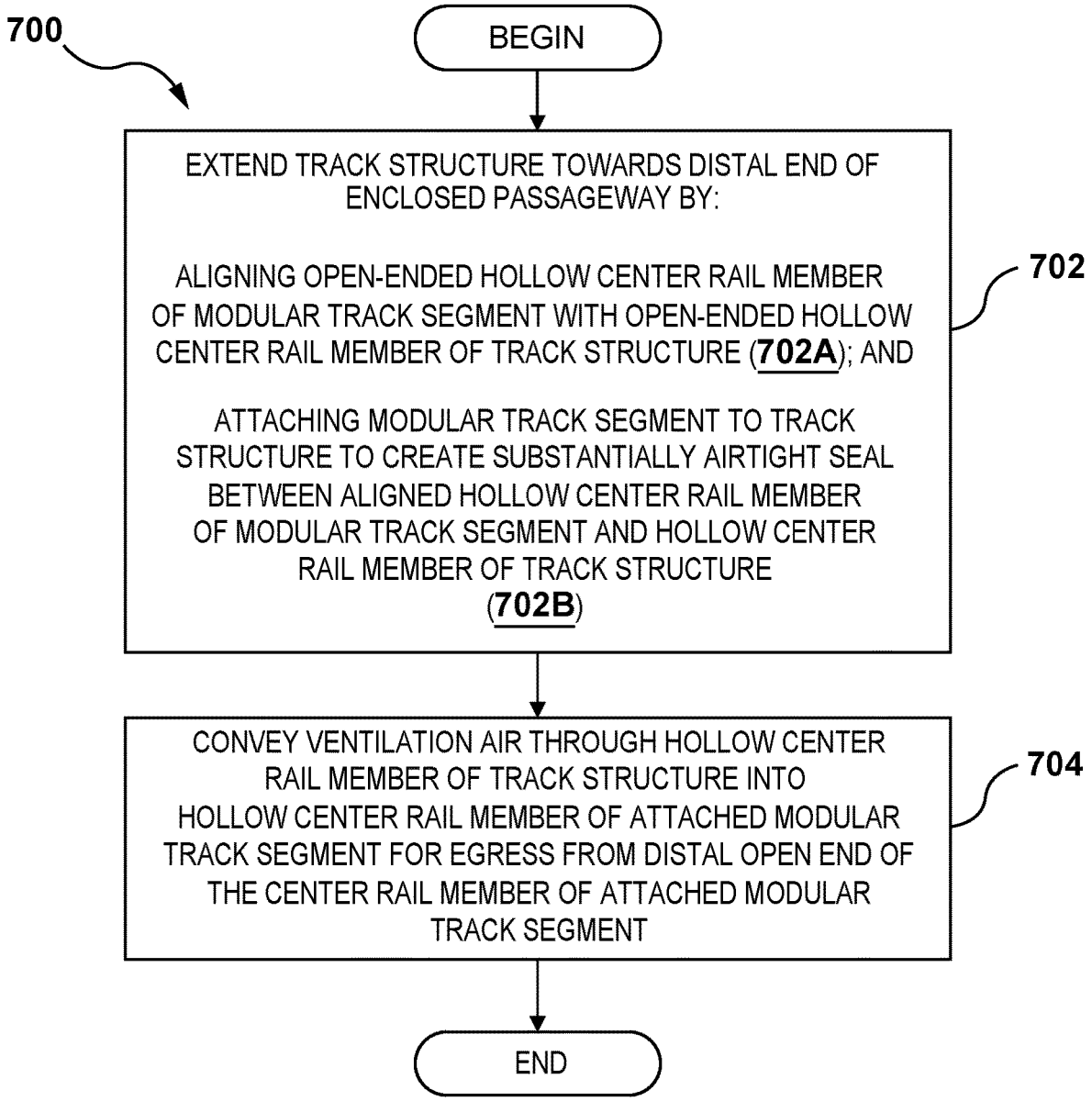
FIG. 14 is a flowchart depicting operations for ventilating a distal end of the tunnel of FIG. 12.

Operation 700 for ventilating a distal end of a tunnel 200 (or other enclosed passageway) using a track structure 300 for wheeled vehicles 400 is depicted in the form of a flowchart in FIG. 14. Operation 700 will be described in conjunction with FIGS. 15 to 17, which schematically depict the tunnel 200 during various stages of operation 700.

Figure 15:
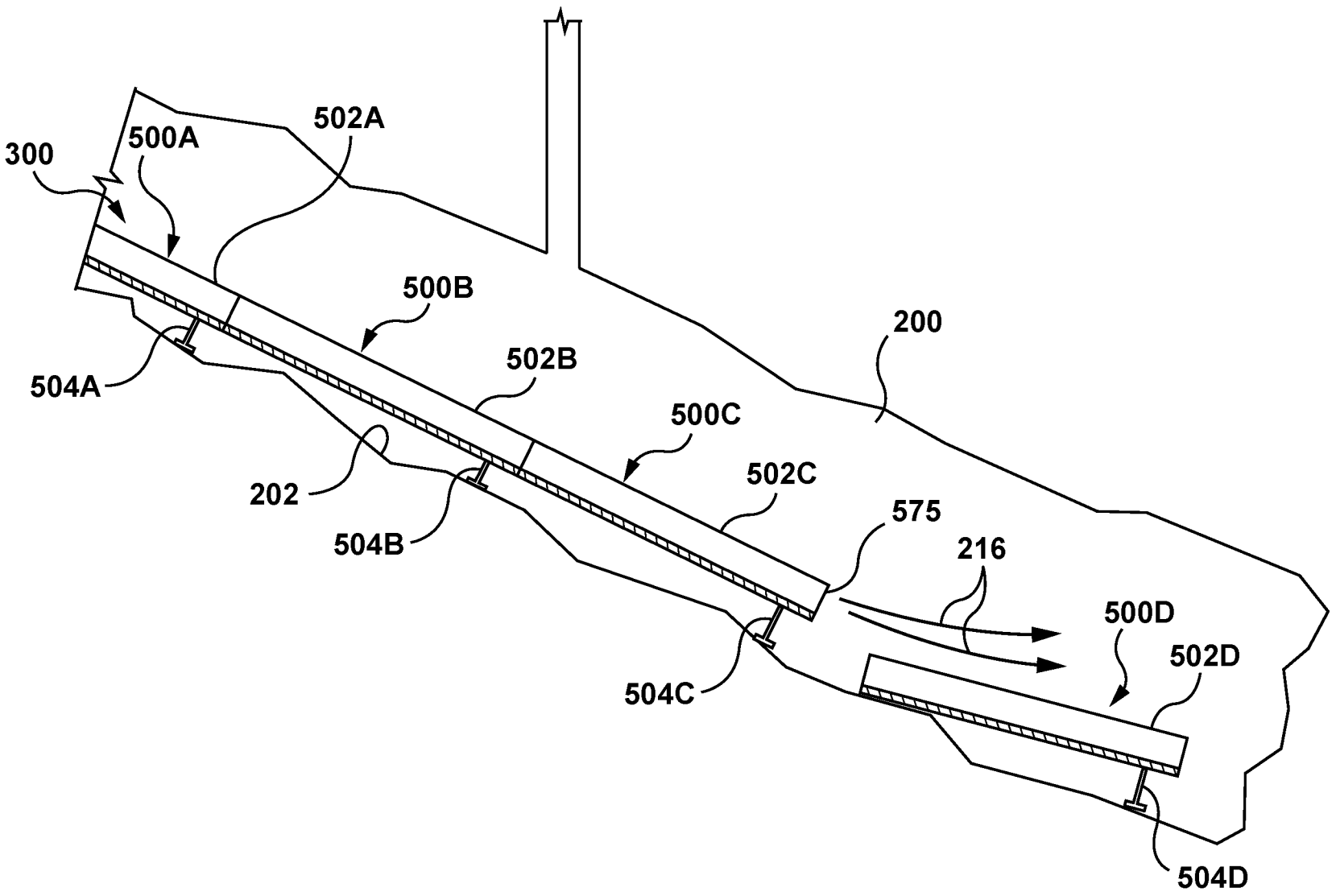
FIG. 15 schematically depicts the distal end of the tunnel of FIG. 12 before the operation of FIG. 14 is performed.

It is presumed that, at the commencement of operation 700, the initial state of the tunnel 200 is as shown in FIG. 15. In particular, the installed track structure 300 has been assembled by interconnecting modular track segments 500A, 500B, and 500C. The open-ended hollow center rail members 502A, 502B, and 502C, respectively, of these segments have been aligned and interconnected with one another, collectively forming a continuous, substantially airtight ventilation duct. It is further presumed that fresh air 216 from surface level or other area of fresh air is being blown, e.g. using the mechanism shown in FIGS. 21 and 22, through the hollow center rail members 502A, 502B, and 502C and is exiting the open end 575 of the latter component. A new modular track segment 500D to be used for extending the track structure 300 initially rests on the tunnel floor 202.

In a first operation, the track structure 300 is extended towards a distal end of the enclosed passageway (tunnel) 200 (operation 702, FIG. 14). This operation may be performed in two steps.

Figure 16:
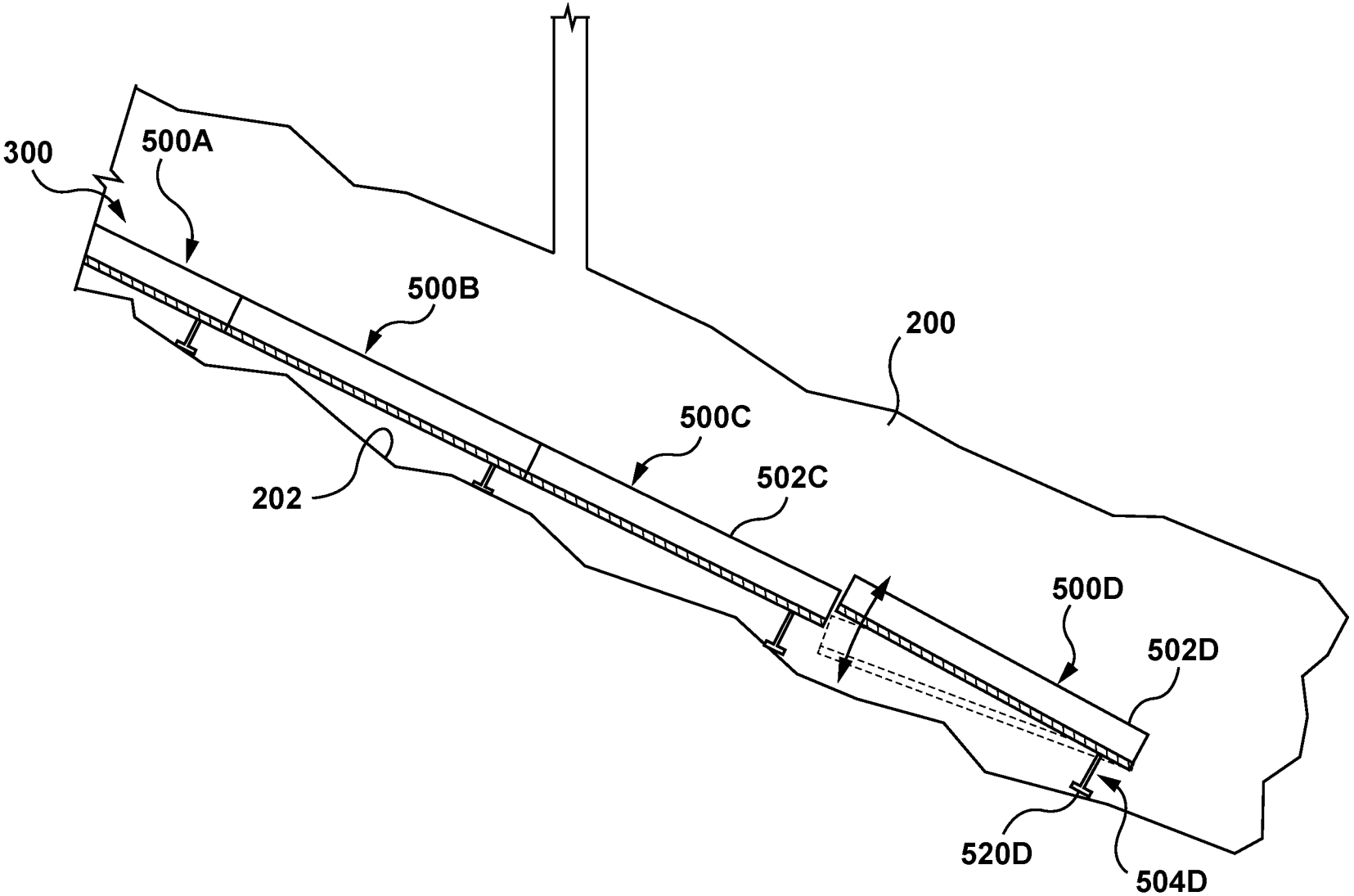
FIG. 16 schematically depicts the distal end of the tunnel of FIG. 12 as the operation of FIG. 14 is being performed.

In a first step (702A), the open-ended hollow center rail member 502D of the new modular track segment 500D is aligned with the open-ended hollow center rail member 502C of the installed track structure 300. Referring to FIG. 16, alignment may be effected by first placing a base portion 520D of the sole support member 504D on the tunnel floor 202 at its likely point of anchoring. This establishes a pivot point for the modular track segment 500D. If necessary, a height of the support member 504D may be adjusted before the pivot point is established, e.g. with a view to promoting axial alignment of the modular track segment 500D with the installed track structure 300. The required height may be measured prior to placement of the rail section and can be adjusted if necessary once modular track segments are connected.

In a second step (702B), the modular track segment 500 is pivoted on the pivot point by raising or lowering an opposite (here, uphill) proximal open end of the center rail member 502D for alignment with the open end of center rail member 502C of the track structure 300. Alignment may be facilitated by the guides 509 on the connector flange 501 of the center rail member 502C (see e.g. FIG. 5).

The location of pivot point (base portion 520D) closer to the distal open end 575 of center rail member 502D than to its proximal (uphill) end may be beneficial, because it may minimize the impact to track straightness of choosing a less-than-ideal height for the support member 504D. In this context, "less than ideal" refers to a height of support member 504D that does not yield perfect axial alignment between track structure 300 and the modular track segment 500D in the vertical dimension. The impact may be minimized in the sense that whatever angular misalignment between the new modular track segment 500D and the installed track structure 300 may result from an imperfectly chosen height of support member 504D would likely be small. The reason is that any inaccuracy in the chosen height of support member 504 would likely be dwarfed by the distance between the to-be-connected end of the segment 500D and the support member 504D. Therefore, any resultant angular axial misalignment of the new modular track segment 500D with the installed track structure 300 would likely be limited to a few degrees. Put another way, the likelihood of any significant angular discontinuities between track segments 500 may be reduced. In any case, adjustments can be made to the height of the support member 504D after connecting the two rail sections, if required, to address any undue angular discontinuity.

Subsequently, the new modular track segment 500D is attached to the installed track structure 300 (operation 702B, FIG. 14). In the present embodiment, attachment is achieved by interconnecting three pairs of adjacent connector flanges 501 of center rail members 502C, 502D, e.g. using fasteners such as bolts, to connect the center rail members 502C, 502D to one another with their open ends in alignment. Depending on the velocity of ventilation air 216 and ambient conditions (e.g. the presence or absence of dust or moisture), it may be permissible or advantageous to reduce or temporarily suspend ventilation to facilitate the track attachment process.

In view of the gasket 505 of center rail member 502D (see FIG. 3), the attaching creates a substantially airtight seal between the aligned hollow center rail members 502C, 502D.

The standard rails 506 of segment 500D are interconnected with the free ends of the corresponding standard rails 506 of the track structure 300, e.g. using splice bars and fish bolts. Additionally, the electrical conductors 510, 512 of the modular track segment 500D may be interconnected with the respective conductors 510, 512 of the of the track structure 300. As well, the base portion 504D of modular track segment 500D may be anchored to the tunnel floor 202, e.g. using mechanical type anchor bolts, at this time.

Figure 17:
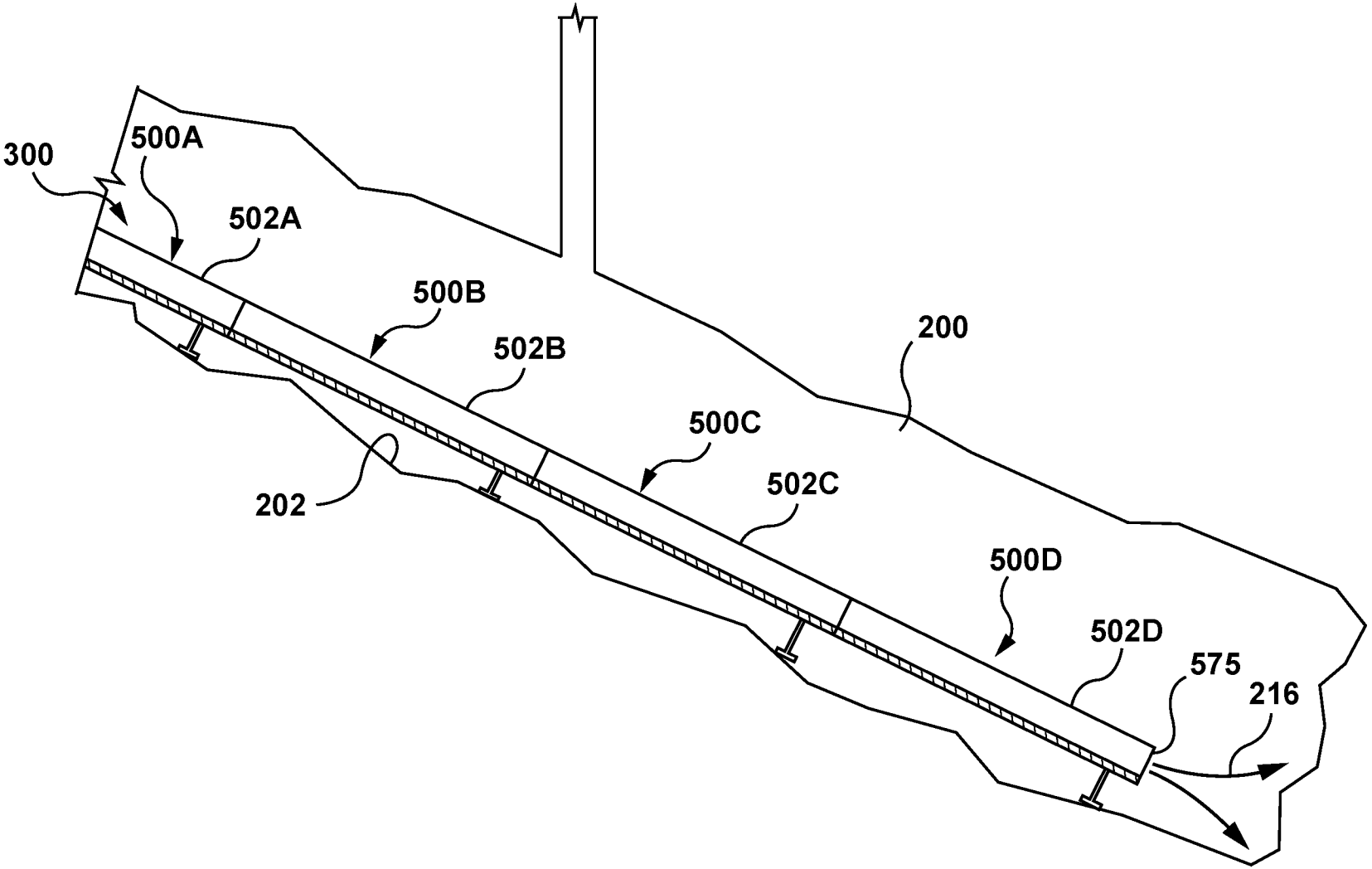
FIG. 17 schematically depicts the distal end of the tunnel of FIG. 12 after the operation of FIG. 14 has been performed.

At this stage, supplementary ventilation air 216 can be conveyed through the hollow center rail members 502A, 502B, 502C of the previously installed track structure 300 into the hollow center rail member 502D of the newly attached modular track segment 500D for egress from the distal open end 575 of the center rail member 502D (operation 704, FIG. 14), as shown in FIG. 17.

As should now be appreciated, additional modular track segments 500 can be attached to the track structure 300 as the tunnel 200 is further excavated. With each added segment 500, the location of the open end 575 of the center rail member 502 of the growing track structure 300, from which supplementary fresh air 216 is output, is progressively advanced. The supplementary fresh air 216 may help to dissipate harmful gases, heat, and/or dust from the work area 230 at a distal end of tunnel 200, where excavation work may be ongoing, and to exhaust them through the nearest raise 212.

Advantageously, this approach may relieve mining personnel of the burden of assembling or installing separate, dedicated ventilation ducting, e.g. similar to ventilation pipe 180 of FIG. 1. The absence of separate ducting means that the amount of material to be excavated to create tunnel 200 may be minimized. As the track structure 300 is extended (lengthened), mining personnel can benefit from the fresh air being output from the open end of the most recently attached center rail member 502. By extending of the track structure 300 close to, and possibly in lockstep with, the advancement of work area 230, a supply of supplementary ventilation to the distal end of the tunnel 200 may be continually provided.

In some areas of track structure 300, e.g. portions that are above-ground (i.e. not within an enclosed passageway), the above-described ventilation pipe capability of track structure 300 may not be strictly required. In such areas, an alternative embodiment of modular track segment 500, as shown in FIGS. 18 and 19, may be used to construct the track structure.

Figure 18:
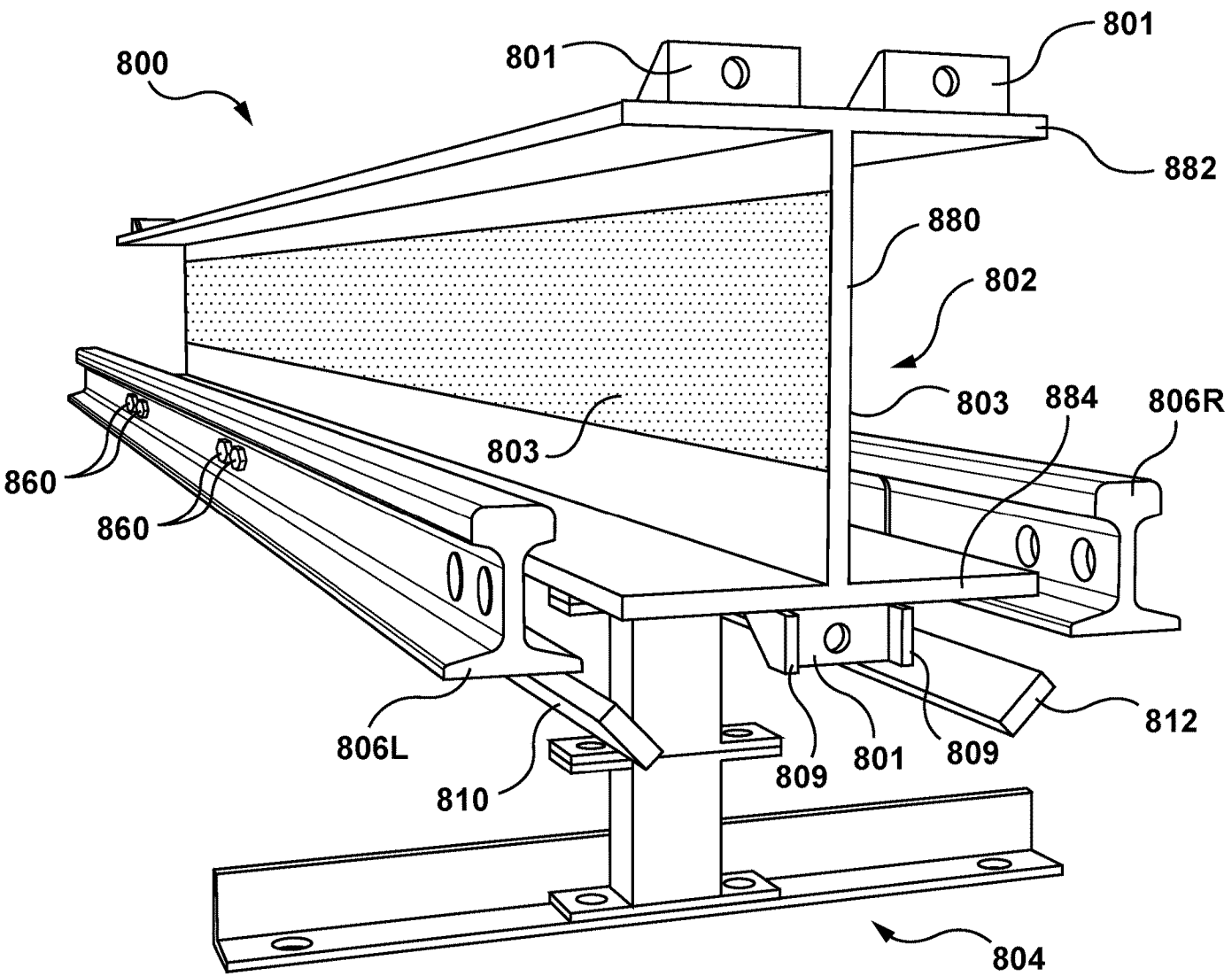
FIG. 18 is a front perspective view of an alternative modular track segment of an alternative track structure for the wheeled vehicle of FIG. 1.
Figure 19:
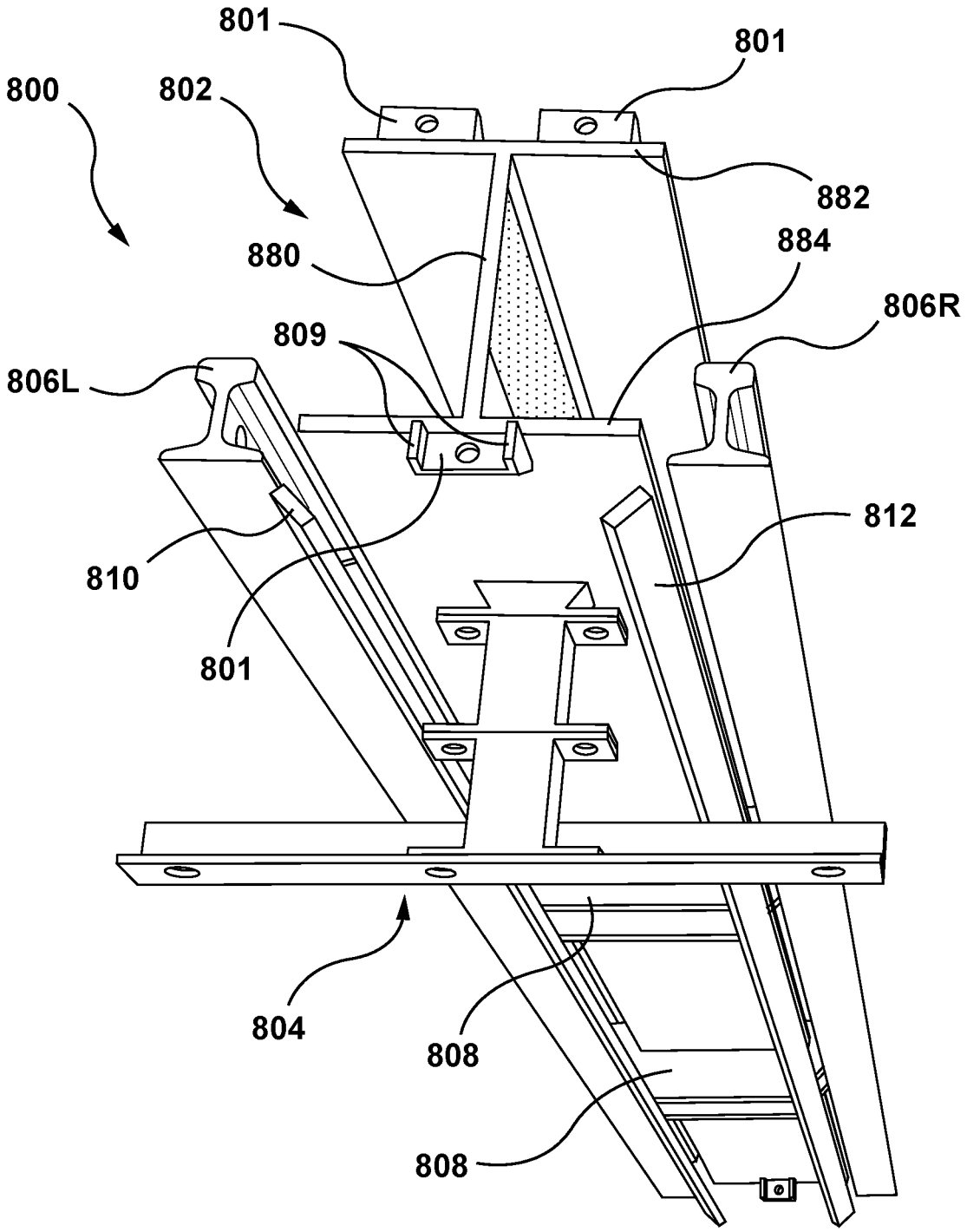
FIG. 19 is a front, bottom perspective view of the alternative modular track segment of FIG. 18.

FIGS. 18 and 19 illustrate an alternative straight modular track segment 800 in front left perspective view and front bottom right perspective view, respectively. In many respects, the modular track segment 800 is similar to modular track segment 500 depicted in FIGS. 2-5. For example, the modular track segment 800 includes a longitudinally offset, adjustable-height support member 804, a pair of rails 806L and 806R (generically or collectively rail(s) 806) removably attached to rail support structure (brackets) 808 by bolts 860, a pair of electrical conductors 810 and 812 whose exposed contact surfaces face downwardly, connector flanges 801 (each a form of connector), and alignment guides 809. Each of these components may be similar or identical to the components of modular track segment 500 of the same name, described above.

A key difference from modular track segment 500, however, is that the center rail member 802 of modular track segment 800 is not hollow. The reason is that the center rail member 802 is not intended to act as a ventilation pipe, e.g. because the modular track segment 800 may be intended for assembling a portion of track structure 300 that is entirely above-ground. In that case, the center rail member 802 may be intended to act as a center rail for the drive unit of the wheeled vehicle 400 without providing any ventilation duct capability.

The example center rail member 802 of FIGS. 18 and 19 is an I-beam oriented with its web portion 880 being substantially vertical and its flange portions 882, 884 substantially horizontal. The drive wheels 610 of the drive unit 600 may be intended to grip lateral wheel contact surfaces 803 on either side of the web portion 880, which may have a high-friction surface or abrasive texture for maximizing traction. The horizontal upper flange portion 882 may advantageously shield the web portion 880, at least to some extent, from the elements (e.g. rain, snow, or ice) to which the modular track segment 800 may be exposed if installed outdoors. The solid web portion 880 may be capable of withstanding greater gripping forces F from the drive wheels 610 than the hollow center rail member 502 of FIGS. 2-5 without any deformation.

Figure 20:
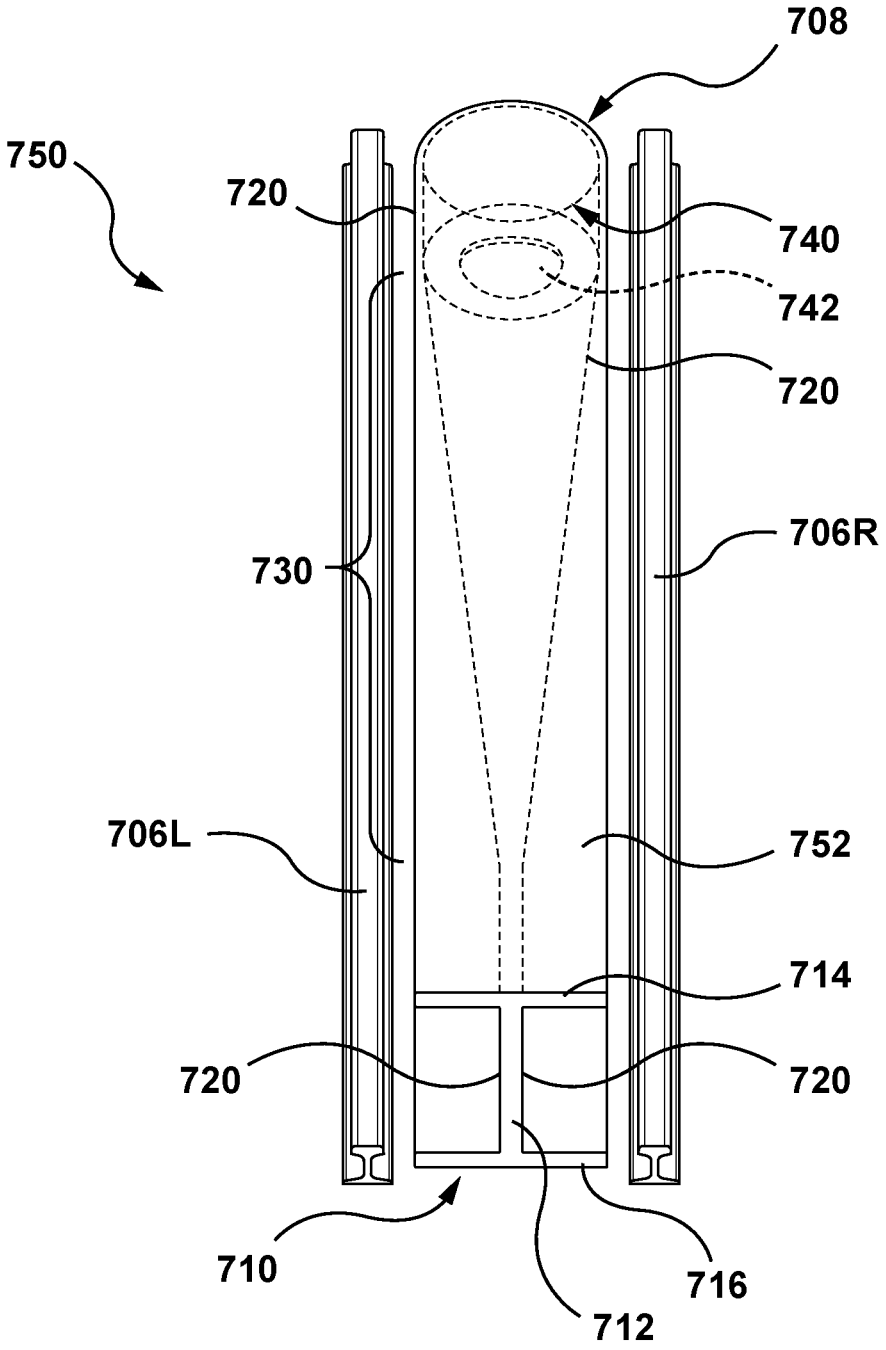
FIG. 20 is an isometric view of an adapter track segment for installation between a modular track segment as shown in FIG. 2 and a modular track segment as shown in FIG. 18.

FIG. 20 is an isometric top view of an adapter track segment 750. This segment 750 may be installed between a modular track segment 500 having a hollow center rail member 502 (as in FIGS. 2-5) and a modular track segment 800 having an I-beam center rail member 802 (as in FIGS. 18 and 19), in order to facilitate a smooth transition between the two by a passing wheeled vehicle 400. The adapter track segment 750 has a center rail member segment 752 and a pair of rails 706L, 706R flanking and substantially parallel to the center rail member segment 752. The rails 706L, 706R are elevated, e.g. using rail support structure analogous to brackets 508 or 808 described above (not expressly depicted), for similar reasons. The adapter track segment 750 may also have a support member (not expressly depicted) analogous to support member 504 or 804, described above, to facilitate installation.

The center rail member segment 752 has an open end 708 and an I-beam shaped end 710. The open end 708 opens into a hollow cylindrical portion 740 having a cross-sectional size and shape similar to that of the hollow center rail member 502 of modular track segment 500. The I-beam shaped end 710 is an I-beam having a cross-sectional size and shape similar to that of the center rail member 802 of the non-hollow modular track segment 800, and similarly oriented with its web portion 712 being substantially vertical and its flange portions 714, 716 substantially horizontal.

The center rail member segment 752 has two laterally opposed, outwardly facing wheel contact surfaces 720 along its length for engagement by the drive wheels 610 of the drive unit 600, described above. At the I-beam end 710, the two wheel contact surfaces 720 are the flat, vertical (lateral) faces of the web portion 712 of the I-beam. At the cylindrical open end 708, each wheel contact surface 720 is a curved surface spanning approximately 60 degrees of a respective one of the two lateral faces of the cylindrical pipe.

The center rail member segment 752 further includes a tapered section 730 between the open end 708 and the I-beam shaped end 710. In the direction from the latter end to the former, the two wheel contact surfaces 720 become progressively wider apart and, in this embodiment, transition from flat to curved. The tapered portion 730 allows the wheels 610 of a drive unit 600 riding along adapter segment 750 to gradually transition from a narrower separation distance (as between the wheel contact surfaces 803 of track segment 800) to a wider separation distance (as between the wheel contact surface 503 of the track segment 500), or vice-versa, depending on the direction of travel. The tapered section 730 may or may not be hollow.

Figure 21:
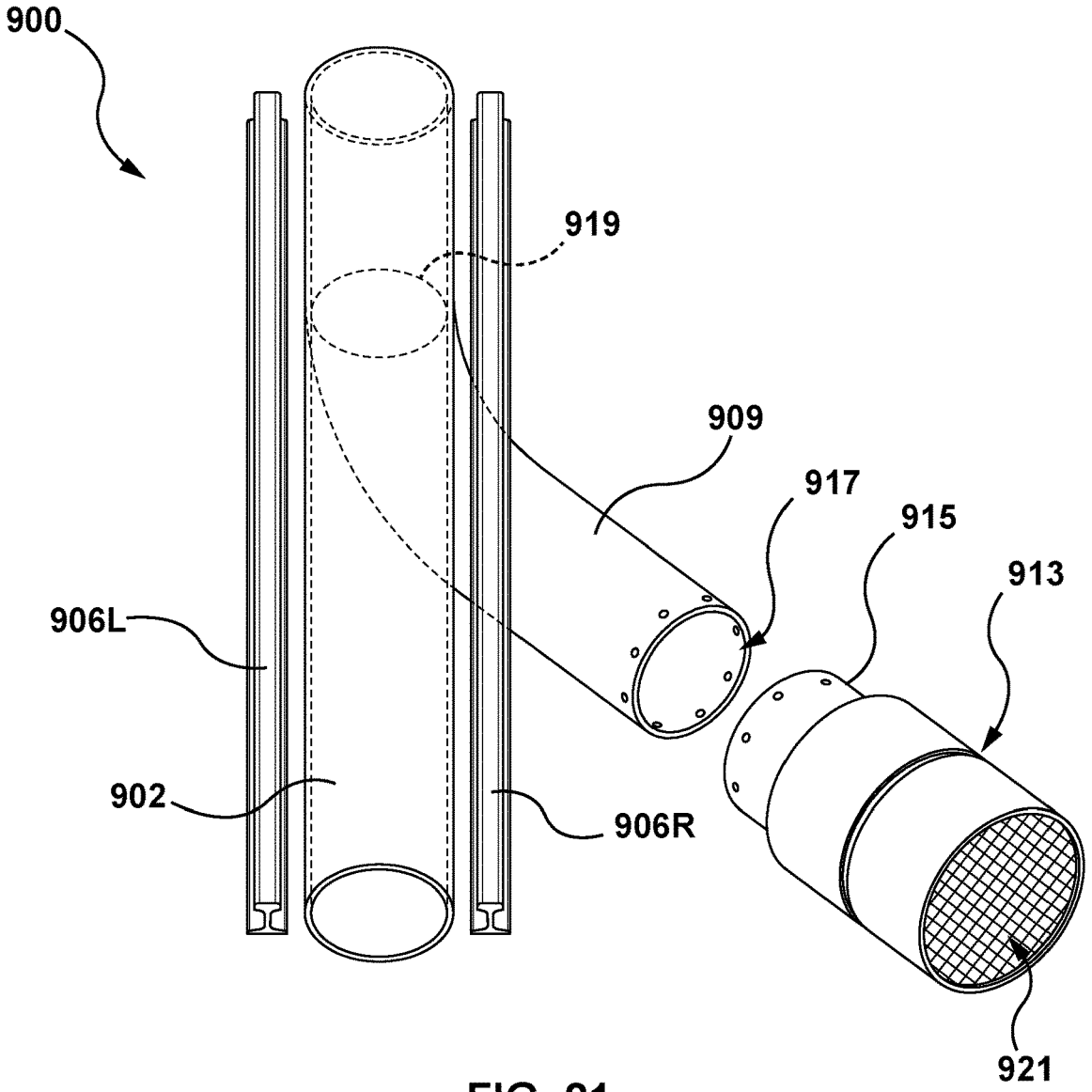
FIG. 21 is an isometric top view of an air ingress track segment having an air inlet and a removable fan attachment.
Figure 22:
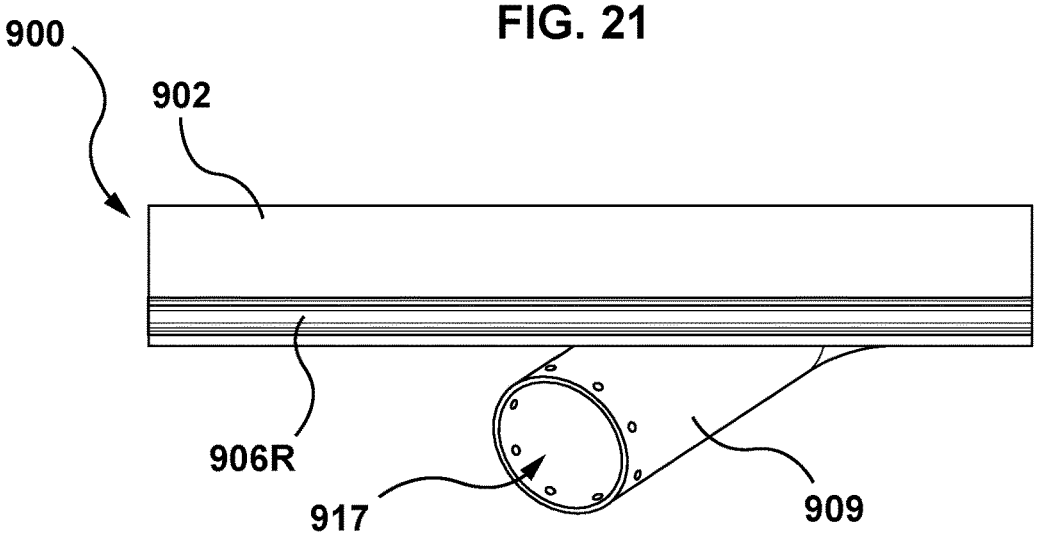
FIG. 22 is a side view of the air ingress track segment of FIG. 21 without the fan attachment.

The hollow portion 740 has an opening 742 on its underside for ingress or egress of ventilation air. In the former case, the ventilation air may be received via opening 742 from a ventilation fan attachment similar to what is depicted in FIGS. 21 and 22 described below. The fan attachment may blow fresh air into the hollow center rail member 502 of an adjacent modular track segment 500 via the hollow portion 740.

Each end 708, 710 of the center rail member segment 752 may have connectors, similar to connectors 501 and 801 for example, for facilitating interconnection of those ends of the center rail member segment 752 with the ends of center rail members 502 and 802 of adjacent track segments 500 and 800 respectively (not expressly depicted).

FIGS. 21 and 22 illustrate an example ventilation air ingress track segment 900. This segment 900 may be incorporated into a track structure 300, e.g. at surface level or at another location where fresh air is present, in order to introduce ventilation air into the hollow center rail member of track structure 300 for conveyance towards a poorly ventilated tunnel section. FIG. 21 is a top front isometric view of the mechanism 900 along with a removable fan attachment 913, and FIG. 22 is a side view of the mechanism 900 without the fan attachment.

In many respects, the ventilation air ingress track segment 900 is similar to the modular track segment 500 described above. The track segment has a hollow cylindrical center rail member 902 which acts as both a ventilation duct and a center rail. An elevated pair of rails 906L, 906R flanks and is substantially parallel to the center rail member 902. The rails may be supported using rail support structure (not expressly depicted) analogous to rail support structure 508 described above that similarly depends from the center rail member 902. The track segment 900 may also have a support member (not expressly depicted) analogous to support member 504, described above, to facilitate installation.

Unlike modular track segment 500, ventilation air ingress track segment 900 has an air inlet pipe 909 branching from an underside of the hollow center rail member 902. A fan unit 913 containing an electric fan (not visible) is removably attachable to the air inlet pipe 909. In particular, a fitting 915 of the fan unit 913 is configured to fit over an open end 917 of the air inlet pipe 909 for removable attachment using removable fasteners such as screws. When attached and powered on, the fan draws air in through screen 921, into the pipe 909, and further into the center rail member 902 via opening 919. Two baffles (not depicted) within the center rail member 902—one on each side of opening 919—optionally form part of the track segment 900. Each baffle may be independently openable (to permit airflow) or closable (to block airflow), so that airflow direction within the track structure 300 can be controlled.

As should now be appreciated, the use of factory-made modular track segments, such as modular track segment 500, 800, and 900, to assemble the track structure 300 may minimize installation time. The reason is that the work required to create each modular track segment is performed in a factory setting, i.e. off critical path tunnel excavation and track installation tasks. When modular or standard segments are held in inventory, they can be quickly obtained in appropriate numbers and combinations for use in constructing track structures in mines of virtually any geometry or configuration. This may reduce or eliminate continual engineering designs and upfront costs for a mining operation. Modular structure components also facilitate disassembly and re-installation, reuse, or resale.

Various alternative embodiments are possible.

Although it may be beneficial for a hollow center rail member of the above-described track structure to be elevated on support members, e.g. for the reasons mentioned earlier in connection with the example track structure 300 and modular track segments 500, this is not strictly required. For example, if a track structure were to be installed in a tunnel (or other enclosed passageway) having a substantially flat floor, its center rail member could conceivably be attached directly to the floor, provided that the pair of rails remains elevated. Such an embodiment is depicted in FIG. 23.

Figure 23:
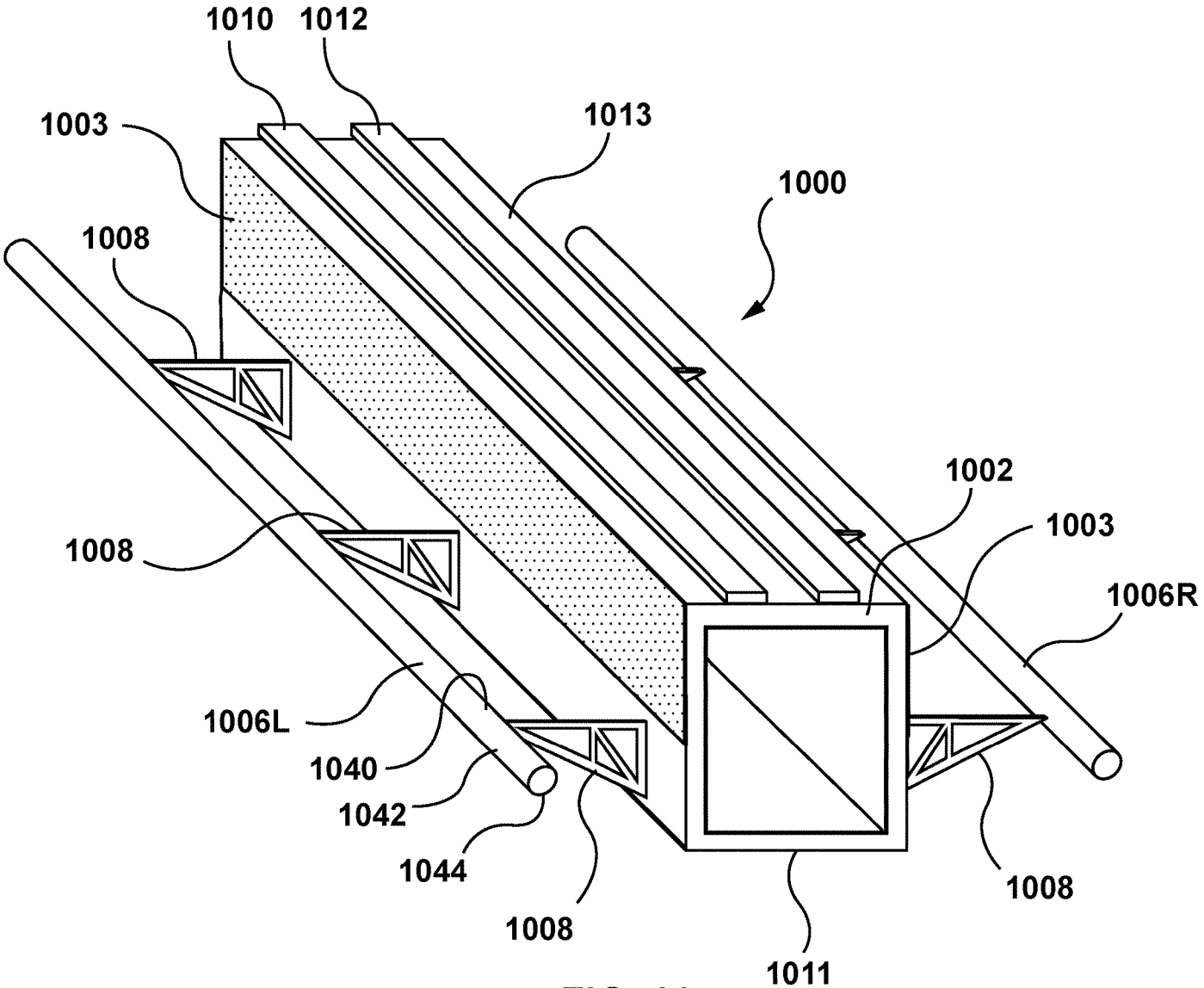
FIG. 23 is a top front perspective view of a further alternative modular track segment of an alternative track structure for a wheeled vehicle for hauling a payload up an inclined tunnel.

FIG. 23 illustrates an alternative straight modular track segment 1000 in top front isometric view. It will be appreciated that variations of this modular track segment 1000, e.g. ones that are laterally or vertically curved with various curvature radii, may also be used, possibly in combination with one or more straight segments as shown in FIG. 23, to assemble a track structure whose geometry conforms to that of an enclosed passageway in which it is installed.

The modular track segment 1000 includes a hollow center rail member 1002 that, like center rail member 502 described above, is configured to act as both a center rail for a wheeled vehicle and as a ventilation duct. In its capacity as a center rail, the center rail member 1002 is sufficiently rigid to withstand gripping forces that will be applied, by an opposed pair of inwardly biased drive wheels of the wheeled vehicle, to the wheel contact surfaces 1003 on its opposite sides.

Like center rail member 502 of FIGS. 2-5, the center rail member 1002 is substantially airtight and is sized to permit a sufficient volume of airflow for its intended use as a ventilation duct. Unlike the center rail member 502, however, the center rail member 1002 has a rectangular cross-sectional shape. This shape may be less efficient than a circular cross-sectional shape for use as a ventilation duct, taking into consideration a possible loss of efficiency especially on corners, but may still be adequate for some applications. The material from which the center rail member is made should be sufficiently strong to prevent the squeeze forces of the drive wheels from significantly or detrimentally deforming the walls of the pipe with extended use and possible fatigue.

The example modular track segment 1000 further includes an elevated pair of rails 1006L and 1006R (generically or collectively rail(s) 1006). Like rails 506, described above, the rails 1006 flank, and are substantially parallel to, their associated hollow center rail member 1002, and are intended to bear a weight of the wheeled vehicle that will ride upon them. Unlike the standard rails 506 of the previously described embodiment, however, the rails 1006 in this embodiment have a cylindrical shape. This illustrates the fact that the upper surface 1040, lower surface 1042, and lateral surface 1044 of the rails may be curved rather than flat. The rails may have other shapes in other embodiments.

The pair of rails 1006 is attached to the hollow center rail member 1002 by rail support structure 1008, which in this example is made up of multiple brackets different from brackets 508 or 808. The rail support structure 1008 is configured to support the elevated pair of rails 1006 with sufficient clearance on an underside of each rail 1006 for an undermount wheel of the wheeled vehicle to roll unobstructed along the underside of the rail. The rationale for the undermount wheels is the same as for the above-described embodiment: to reduce a risk of wheeled vehicle derailment.

The modular track segment 1000 further includes a pair of electrical conductors 1010, 1012 that span the length of the modular track segment 1000. These conductors 1010, 1012 are intended to supply electrical current to electric motors of a wheeled vehicle driving along track segment 1000. However, unlike the electrical conductors 510, 512 of the modular track segment 500 described above, the electrical conductors 1010, 1012 are mounted directly to center rail member 1002, on its top surface 1013. If the center rail member 1002 is made from an electrically conductive material, insulators may separate the conductors 1011, 1012 from rail member 1002. The top-mounted design may be less desirable than a design in which the exposed contact surfaces of the electrical conductors face downwardly, which may limit accretion of dust or other material that could interfere with electrical conduction with the drive unit, but may nevertheless be workable in some applications.

It will be appreciated that the modular track segment 1000 may include various other components, e.g. guides for aligning adjacent segments 1000, connectors for interconnecting adjacent segments 1000, a gasket for creating an airtight seal between center rail member 1002 and an adjacent center rail member, and/or anchors for anchoring an underside 1011 of center rail member 1002 to the floor of an enclosed passageway in which the modular track segment 1000 is installed, which are omitted from FIG. 23 for brevity.

As alluded to above, components that are subject to wear, such as the rails 506, may be made replaceable to facilitate track structure upkeep. Other replaceable components may include all of the wheels of the drive unit 600, including drive wheels 610. In contrast, components that are unlikely to wear need not necessarily be made easily replaceable. These components may include the center rail member 502, which is only contacted by the rubber drive wheels 610 during normal operation and thus is unlikely to become worn.

It will be appreciated that the cross-sectional shape of a tunnel 200 in which the track structure 300 is installed may not actually be perfectly circular as depicted in FIG. 1. The reason is that the tunnel may be excavated using relatively crude techniques, e.g. detonating explosive charges in an array of drilled holes to break up the rock and then removing the broken rock fragments. This may produce a tunnel whose cross-sectional shape is substantially, versus precisely, circular. Alternatively, the tunnel could have another cross-sectional shape.

In some embodiments, the modular track segment may lack dedicated electrical conductors. For example, if the wheeled vehicle is by a battery that is carried on the vehicle itself, the conductors could be omitted. In some embodiments, either one or both of the rails of the track structure could replace (i.e. could be used as) an electrical conductor. In some embodiments, the electrical conductors could be separate from the track structure.

It is possible that, in some embodiments of wheeled vehicle, the side (guide) wheels that roll along a lateral face of each rail may face outwardly, i.e. may be intended to roll over an inner lateral surface of the rail, rather than being intended to roll over the outer lateral surface of the rail like wheel 642 of FIG. 9. In such embodiments, the rail support structure of the track structure may be configured to attach to the outer lateral surface of the rail rather than the inner lateral surface of the rail.

Although the connectors 501 or 801 that are used to interconnect adjacent center rail members 502 or 802 respectively are connector flanges spaced about each end of each center rail member for interconnection using fasteners such as bolts, other types of connectors could be used. For example, in the case of a center rail member that is a cylindrical pipe, a single annular flange extending radially from the entirety of the periphery of each end of the pipe could be used. Alternatively, multiple part-annular flanges extending from portions of the periphery of each end of the pipe could be used. Such flanges could be interconnected using bolts or other fasteners. To avoid creating an obstacle for the drive wheels 610, it may be preferred to use part-annular flanges positioned so as not to block or encroach upon either of the lateral wheel contact surfaces rather than a full annular flange. Other form of connectors that could be used may include pipe fittings or pipe couplings, although these may be less convenient to apply or remove and may complicate maintenance. The fasteners used to establish such connections may be removable to facilitate track maintenance and repair, although permanent fasteners or even welding could be appropriate to connect center rail members in some instances.

Other modifications may be made within the scope of the following claims.

What is claimed is:

1. A modular track segment of a track structure usable by a wheeled vehicle for hauling a payload up an inclined enclosed passageway, the modular track segment comprising:

a hollow center rail member configured to act as both a center rail for the wheeled vehicle and as a ventilation duct, the hollow center rail member being rigid with open ends and having, on opposite lateral faces, respective wheel contact surfaces grippable by an opposed pair of inwardly-biased drive wheels of the wheeled vehicle;

rail support structure depending from the hollow center rail member;

an elevated pair of rails attached to the rail support structure, the rails being on opposite sides of and substantially parallel to the hollow center rail member, each rail being supported by the rail support structure so as to provide:

an upper surface suitable for rolling engagement by a weight-bearing wheel of the wheeled vehicle;

a lower surface suitable for rolling engagement by an undermount wheel of the wheeled vehicle; and a lateral surface suitable for rolling engagement by a guide wheel of the wheeled vehicle; and at least one connector configured to facilitate connection of the hollow center rail member with an adjacent hollow center rail member of an adjacent modular track segment so that respective open ends of the center rail members are aligned.

2. The modular track segment of claim 1 further comprising:

a sole support member, attached to the hollow center rail member, configured to elevate the hollow center rail member above a floor of the inclined enclosed passageway, the sole support member being disposed closer to one end of the hollow center rail member than to the other end of the hollow center rail member.

3. The modular track segment of claim 2 wherein the sole support member is of adjustable height to facilitate axial alignment of the hollow center rail member with the adjacent hollow center rail member of the adjacent modular track segment.

4. The modular track segment of claim 1 further comprising a gasket at one end of the hollow center rail member for providing a substantially airtight seal with the adjacent hollow center rail member of the adjacent modular track segment upon the connection of the hollow center rail member with the adjacent hollow center rail member.

5. The modular track segment of claim 1 wherein the hollow center rail member is a cylindrical pipe.

6. The modular track segment of claim 1 wherein the wheel contact surfaces of the hollow center rail member comprise a high-friction surface.

7. The modular track segment of claim 1 wherein each of the rails is removably attached to the rail support structure.

8. The modular track segment of claim 7 wherein the rail support structure comprises:

a plurality of brackets, each bracket being attached to the hollow center rail member; and fasteners for removably attaching the elevated pair of rails to the brackets.

9. The modular track segment of claim 1 wherein the wheeled vehicle is electrically powered and further comprising a pair of electrical conductors spanning the length of the modular track segment, each of the electrical conductors having an exposed contact surface positioned to make electrical contact with a corresponding resilient electrical contact of the wheeled vehicle.

10. The modular track segment of claim 9 wherein the exposed contact surface of each electrical conductor faces downwardly.

11. The modular track segment of claim 1 wherein approximately three-quarters of the hollow center rail member is above the upper surface of the elevated pair of rails.

12. A track structure usable by a wheeled vehicle for hauling a payload up an inclined enclosed passageway, the track structure comprising:

a hollow center rail member configured to act as both a center rail for the wheeled vehicle and as a ventilation duct, the hollow center rail member being rigid and having, on opposite lateral faces, respective wheel contact surfaces grippable by an opposed pair of inwardly-biased drive wheels of the wheeled vehicle;

rail support structure depending from the hollow center rail member; and an elevated pair of rails attached to the rail support structure, the rails being on opposite sides of and substantially parallel to the hollow center rail member, each rail being supported by the rail support structure so as to provide:

an upper surface suitable for rolling engagement by a weight-bearing wheel of the wheeled vehicle;

a lower surface suitable for rolling engagement by an undermount wheel of the wheeled vehicle; and a lateral surface suitable for rolling engagement by a guide wheel of the wheeled vehicle.

13. The track structure of claim 12 wherein the rails are removably attached to the rail support structure.

14. The track structure of claim 12 further comprising an air inlet pipe branching from the hollow center rail member and a fan operable to blow air into the air inlet pipe for conveyance through the center rail member and for egress from a distal open end of the center rail member to ventilate at least a portion of the enclosed passageway.

15. The track structure of claim 12 wherein the rail support structure comprises:

a plurality of brackets, each bracket being attached to the hollow center rail member; and fasteners for removably attaching the elevated pair of rails to the brackets.

16. The track structure of claim 12 further comprising an adapter track segment including:

a center rail member segment having:

an I-beam shaped end with a vertically oriented web portion;

a hollow portion opposite the I-beam shaped end;

an open end that opens into the hollow portion;

an opening into the hollow portion for ingress or egress of ventilation air, the opening being distinct from the open end of the center rail member segment; and a tapered portion between the I-beam shaped end and the open end of the center rail member segment, the tapered portion having opposite lateral faces with respective wheel contact surfaces that become progressively wider apart along the length of the tapered portion in the direction from the I-beam shaped end towards the open end.

17. A method of ventilating a distal end of an enclosed passageway, the method comprising:

extending a track structure previously installed in the enclosed passageway towards the distal end of the enclosed passageway, the track structure having an open-ended hollow center rail member configured to act as both a center rail for a wheeled vehicle and as a ventilation duct, by:

aligning an open-ended hollow center rail member of a modular track segment with the open-ended hollow center rail member of the track structure; and attaching the modular track segment to the track structure to create a substantially airtight seal between the aligned hollow center rail member of the modular track segment and the hollow center rail member of the track structure; and conveying ventilation air through the hollow center rail member of the track structure into the hollow center rail member of the attached modular track segment for egress from a distal open end of the hollow center rail member of the attached modular track segment proximately to the distal end of the enclosed passageway.

18. The method of claim 17 wherein the modular track segment comprises a sole support member depending from the hollow center rail member and wherein the aligning comprises:

placing a base portion of the sole support member on a floor of the enclosed passageway to establish a pivot point for the modular track segment; and pivoting the modular track segment on the pivot point by raising or lowering a proximal end of the open-ended hollow center rail member of the modular track segment for alignment with the open-ended hollow center rail member of the installed track structure.

19. The method of claim 18 wherein the pivot point established by the base portion of the sole support member of the modular track segment is closer to the distal open end of the modular track segment than to the proximal open end of the modular track segment closest to the track structure.

20. The method of claim 18 wherein the aligning further comprises adjusting a height of the sole support member before the pivoting of the center rail member of the modular track segment on the pivot point established by the base portion of the sole support member.

* * * * *